US008820985B1

(12) United States Patent
Tam et al.

(10) Patent No.: US 8,820,985 B1
(45) Date of Patent: Sep. 2, 2014

(54) ADJUSTABLE SUPPORT FOR LAMPS

(75) Inventors: Amos Tam, Atlanta, GA (US); Grzegorz Wronski, Peachtree City, GA (US); Huang Rongxiu, Shanghai (CN)

(73) Assignee: Cooper Technologies Company, Houston, TX (US)

( * ) Notice: Subject to any disclaimer, the term of this patent is extended or adjusted under 35 U.S.C. 154(b) by 298 days.

(21) Appl. No.: 13/222,959

(22) Filed: Aug. 31, 2011

(51) Int. Cl.
*F21S 8/08* (2006.01)
*F21V 21/14* (2006.01)
*F21V 21/30* (2006.01)

(52) U.S. Cl.
CPC ..... *F21V 21/14* (2013.01); *F21V 21/30* (2013.01)
USPC ..... 362/419; 362/429; 362/427; 362/287; 362/269; 362/249.1

(58) Field of Classification Search
USPC ..... 362/523, 530, 249.07, 249.09, 249.1, 362/269, 285, 287, 418, 419, 427, 429, 362/366; 248/274.1, 284.1, 286.1, 287.1, 248/288.11, 291.1, 292.14
See application file for complete search history.

(56) References Cited

U.S. PATENT DOCUMENTS

| | | | | | |
|---|---|---|---|---|---|
| 394,680 | A * | 12/1888 | Dawes | 248/326 |
| 866,473 | A * | 9/1907 | Keefe et al. | 248/326 |
| 2,667,317 | A * | 1/1954 | Trebules | 248/514 |
| 6,036,337 | A * | 3/2000 | Belfer | 362/287 |
| 6,264,152 | B1 * | 7/2001 | Bloch et al. | 248/274.1 |
| 6,652,124 | B2 * | 11/2003 | Schubert et al. | 362/285 |
| 7,559,677 | B1 * | 7/2009 | Dupre | 362/287 |
| 7,641,163 | B2 * | 1/2010 | O'Keene | 248/292.14 |
| 7,690,611 | B2 * | 4/2010 | Asamarai et al. | 248/284.1 |

* cited by examiner

*Primary Examiner* — Ismael Negron
(74) *Attorney, Agent, or Firm* — King & Spalding LLP

(57) ABSTRACT

The adjustable device includes a bracket configured for connection to a substrate, a lamp housing configured for supporting a lamp, and an adjustment system adjustably coupling the lamp housing to the bracket, the adjustment system defining a plurality of different selectable positions of the lamp housing relative to the bracket. The adjustment system enables translation and rotation of the lamp housing relative to the bracket to move the lamp housing between the plurality of selectable positions relative to the bracket. The adjustment system includes a locking system to secure the lamp housing in each of the selectable positions relative to the bracket.

13 Claims, 18 Drawing Sheets

ADJUSTABLE SUPPORT FOR LAMPS

TECHNICAL FIELD

The present disclosure relates generally to devices and methods for use in lighting systems, e.g., lighting structures including movable or removable components for providing access to other particular components.

BACKGROUND

A recessed light, sometimes referred to as a downlight or can light, is a light fixture in a ceiling. Recessed lights may be used for various types of light sources, such as LED, compact florescent, incandescent. When installed, these lighting systems appear to have light shining from an opening in the ceiling, concentrating the light in a downward direction in a shape ranging from a broad floodlight to a narrow spotlight. There are typically two parts to recessed lights, the trim and housing. The trim is the visible portion of the lighting system, which often includes a thin lining around the edge of the light. The housing is the fixture itself that is installed in the ceiling and contains the lamp holder. The housing may be secured in the ceiling in a variety of ways, such as being secured to one or more ceiling joists by suitable brackets.

SUMMARY

In accordance with the teachings of the present disclosure, disadvantages and problems associated with existing lighting systems and devices have been reduced.

According to one aspect of certain embodiments of the invention, an adjustable device for supporting a lamp includes a bracket configured for connection to a substrate, a lamp housing configured for supporting a lamp, and an adjustment system adjustably coupling the lamp housing to the bracket, the adjustment system defining a plurality of different selectable positions of the lamp housing relative to the bracket. The adjustment system enables translation and rotation of the lamp housing to relative to the housing to move the lamp housing between the plurality of selectable positions relative to the bracket. The adjustment system includes a locking system to secure the lamp housing in each of the selectable positions relative to the bracket.

According to another aspect of the certain embodiments of the invention, a lighting apparatus includes a housing, a socket, and an access portion. The housing has a first side and an opposing second side, the first side configured for attachment to a ceiling or wall that separates an interior of a room from an exterior area outside the room. The socket is connected to the housing, and is configured to receive a lamp for emitting light through the first side of the housing and into the interior of the room. The access portion is accessible from the exterior area outside the room and movably or removably coupled to the housing for movement between (a) a first position blocking access to the lamp from the exterior area outside the room and (b) a second position allowing access to the lamp from the exterior area outside the room, such that the access portion may be accessed from the exterior area outside the room and moved from the first position to the second position in order to access the lamp from the exterior area outside the room.

According to another aspect of the certain embodiments of the invention, a lighting system includes a lamp housing, an energy source (e.g., an emergency or backup energy source), a junction box, and an elongated flexible conduit. The lamp housing is configured to house a lamp assembly including a lamp, and has a first side configured for attachment to a ceiling or wall that separates an interior of a room from an exterior area outside the room. The lamp housing is configured to support a lamp arranged to emit light though the first side of the housing and into the interior area of the room. The lamp housing also includes a sidewall extending around at least a portion of the lamp assembly. The energy source is connected to the lamp housing proximate a first area of the lamp housing sidewall. The junction box is spaced apart from the energy source and is connected to the lamp housing proximate a second area of the lamp housing sidewall spaced apart from the first area of the lamp housing sidewall. The elongated flexible conduit is connected at a first end to the energy source and connected at a second end to the junction box. The lamp housing sidewall includes a first movable or removable portion in the first area of the lamp housing sidewall, and a second movable or removable portion in the second area of the lamp housing sidewall. The first and second movable or removable portions of the lamp housing sidewall are accessible from the interior of the room such the first and second movable or removable portions of the lamp housing sidewall can be moved or removed to access the energy source and the elongated flexible conduit from the interior of the room without removing the lamp housing from the ceiling or wall.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIG. 8 illustrates the example lighting system with the housing fully assembled, e.g., in the operational state of the lighting system;

FIG. 9 illustrates the example lighting system with a lid removed to reveal internal components of the lighting system;

FIG. 10 illustrates the example lighting system with a lamp assembly and a first housing portion removed from the lamp housing to provide openings in the lamp housing for accessing an externally located junction box and flexible wiring harness connection from the interior of a room;

FIG. 11 illustrates the example lighting system with the lamp assembly and a second housing portion removed from the lamp housing to provide openings in the lamp housing for accessing an externally located emergency energy source from the interior of the room;

FIG. 12 illustrates the disconnection of the emergency energy source and the flexible wiring harness via the openings in the lamp housing; and FIG. 13 illustrates the removal of the emergency energy source and the flexible wiring harness through the openings in the lamp housing.

DETAILED DESCRIPTION OF THE EXEMPLARY EMBODIMENTS

Preferred embodiments and their advantages over the prior art are best understood by reference to FIGS. 1-13 below. However, the present disclosure may be more easily understood in the context of a high level description of certain embodiments.

The disclosure relates to improved devices for lighting systems, including adjustable or multi-positional lighting housings, and lighting housings including movable or removable components for providing access to other particular components.

Figure 1A:
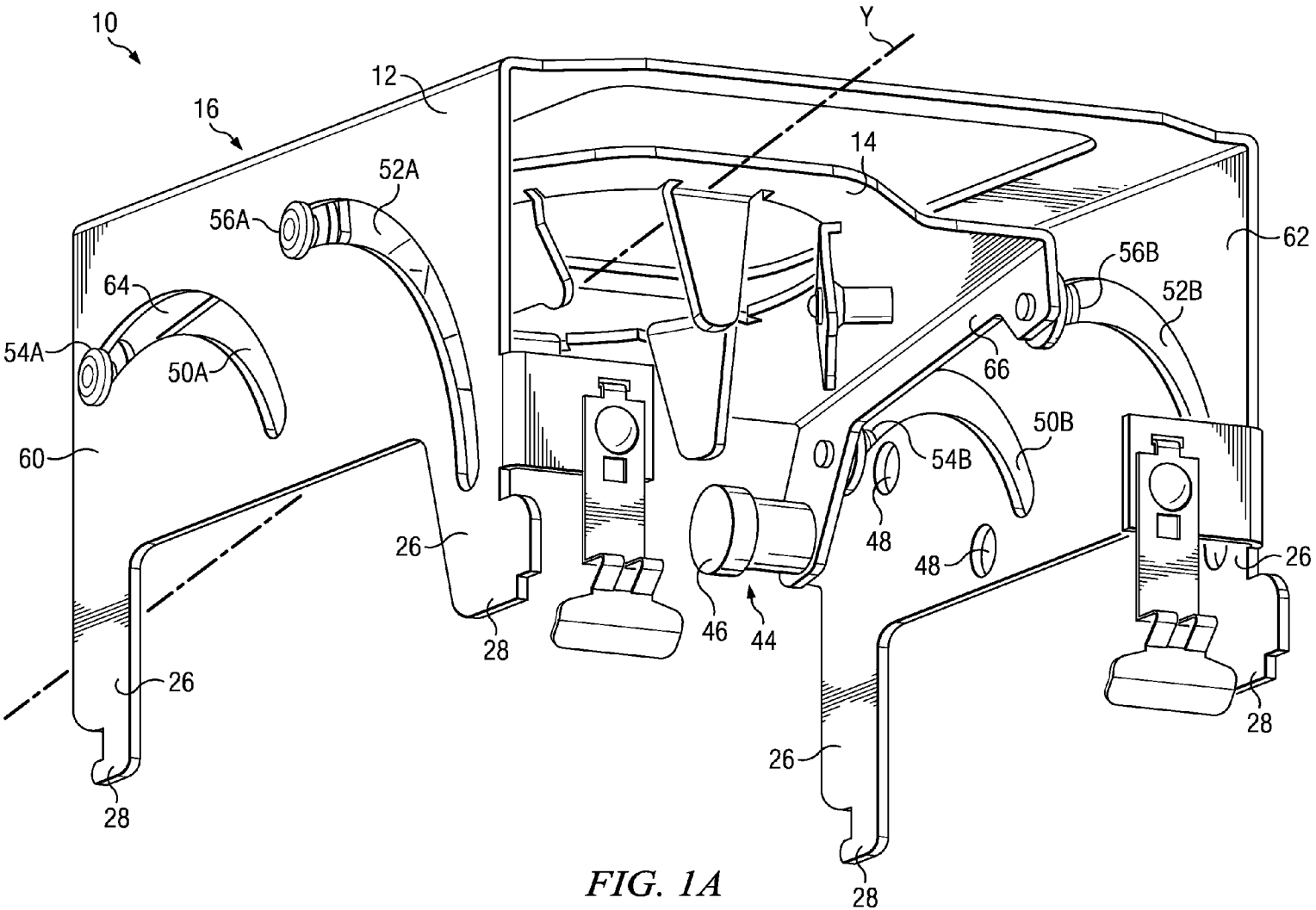
FIGS. 1A-1C illustrate a three-dimensional view of an adjustable device for supporting a lamp in three different user-selected positions, according to an example embodiment of the disclosure.
Figure 2A:
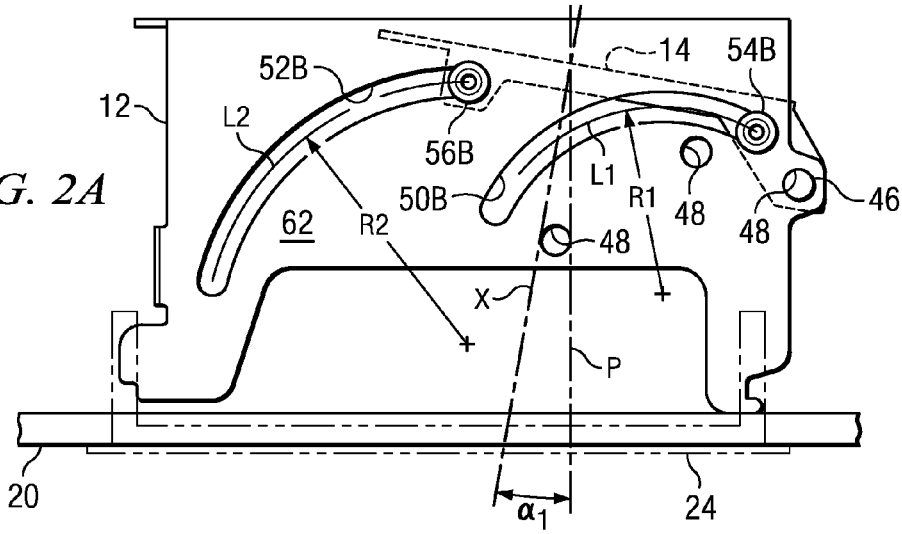
FIGS. 2A-2C illustrate side views of the adjustable device for supporting a lamp in the three different user-selected positions shown in FIGS. 1A-1C, along a first direction of view.
Figure 2B:
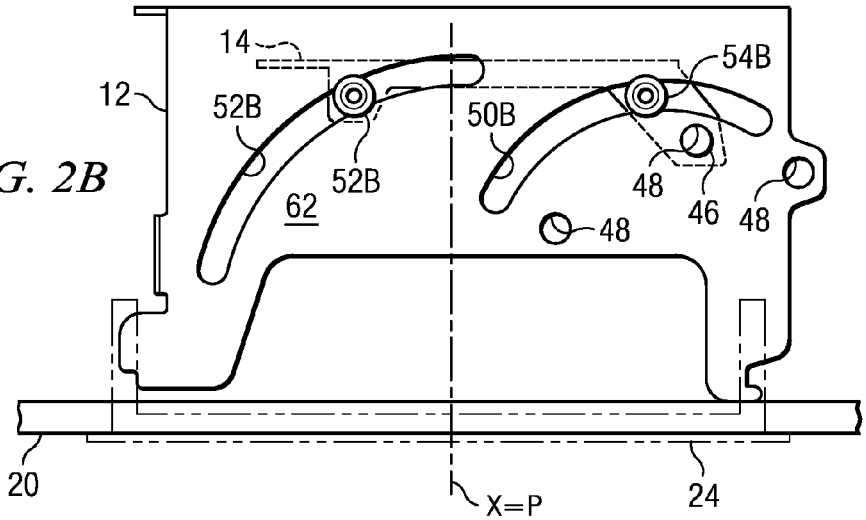
Figure 2C:
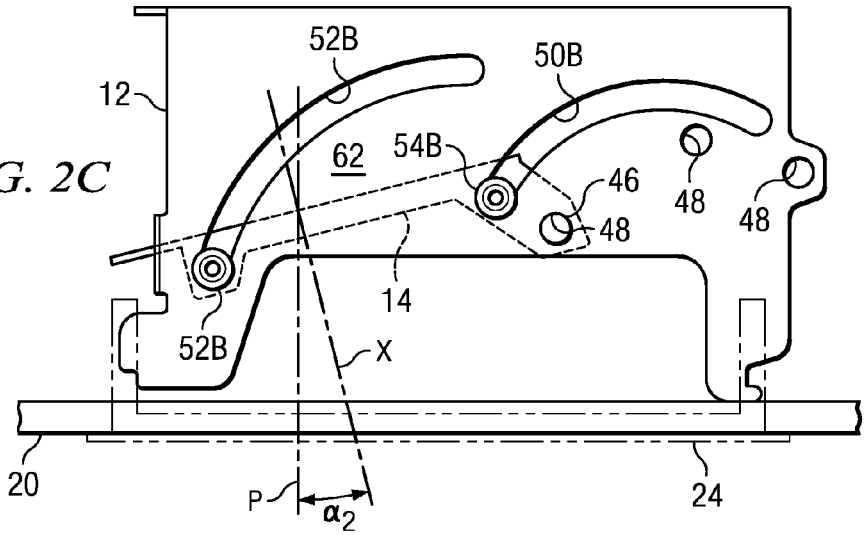
Figure 3A:
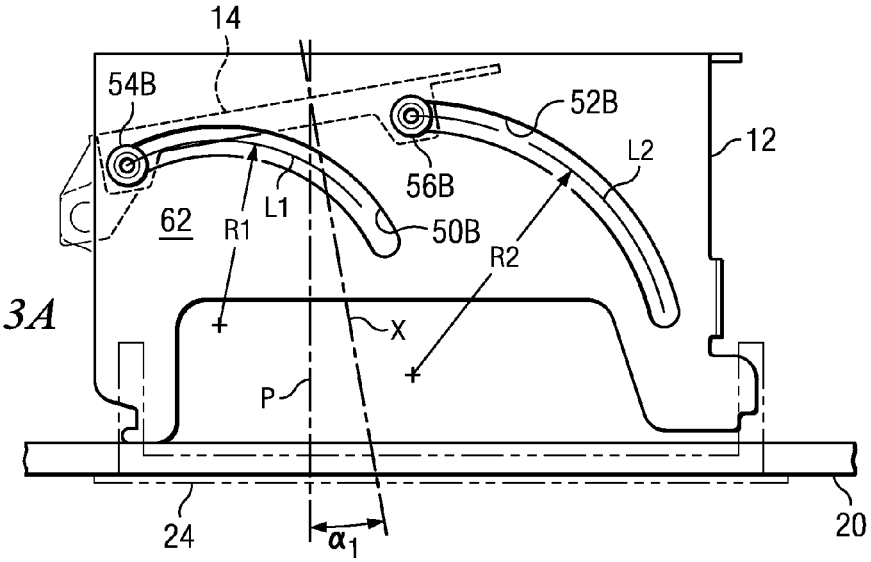
FIGS. 3A-3C illustrate side views of the adjustable device for supporting a lamp in the three different user-selected positions shown in FIGS. 1A-1C, along a second direction of view opposite the first direction of view.
Figure 3B:
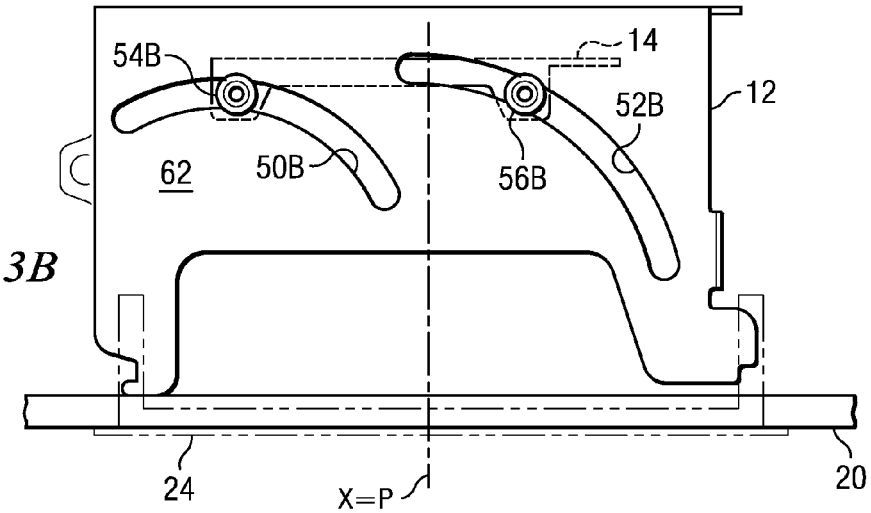
Figure 3C:
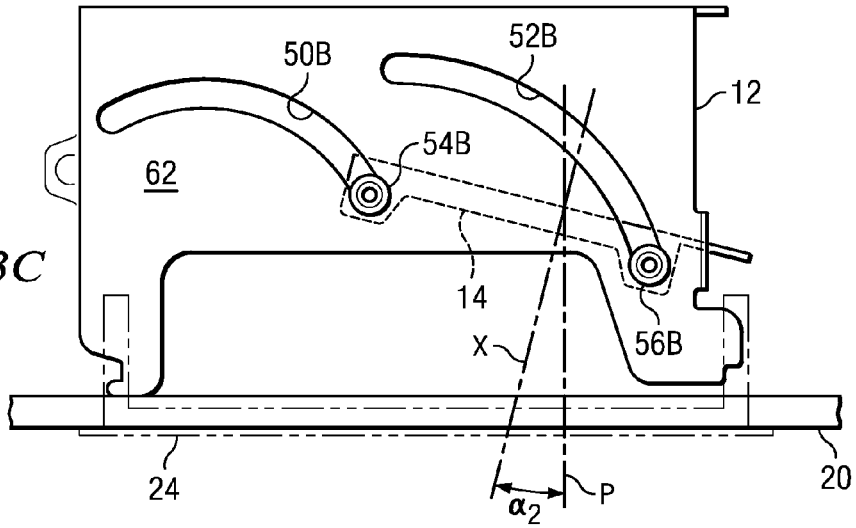
Figure 4:
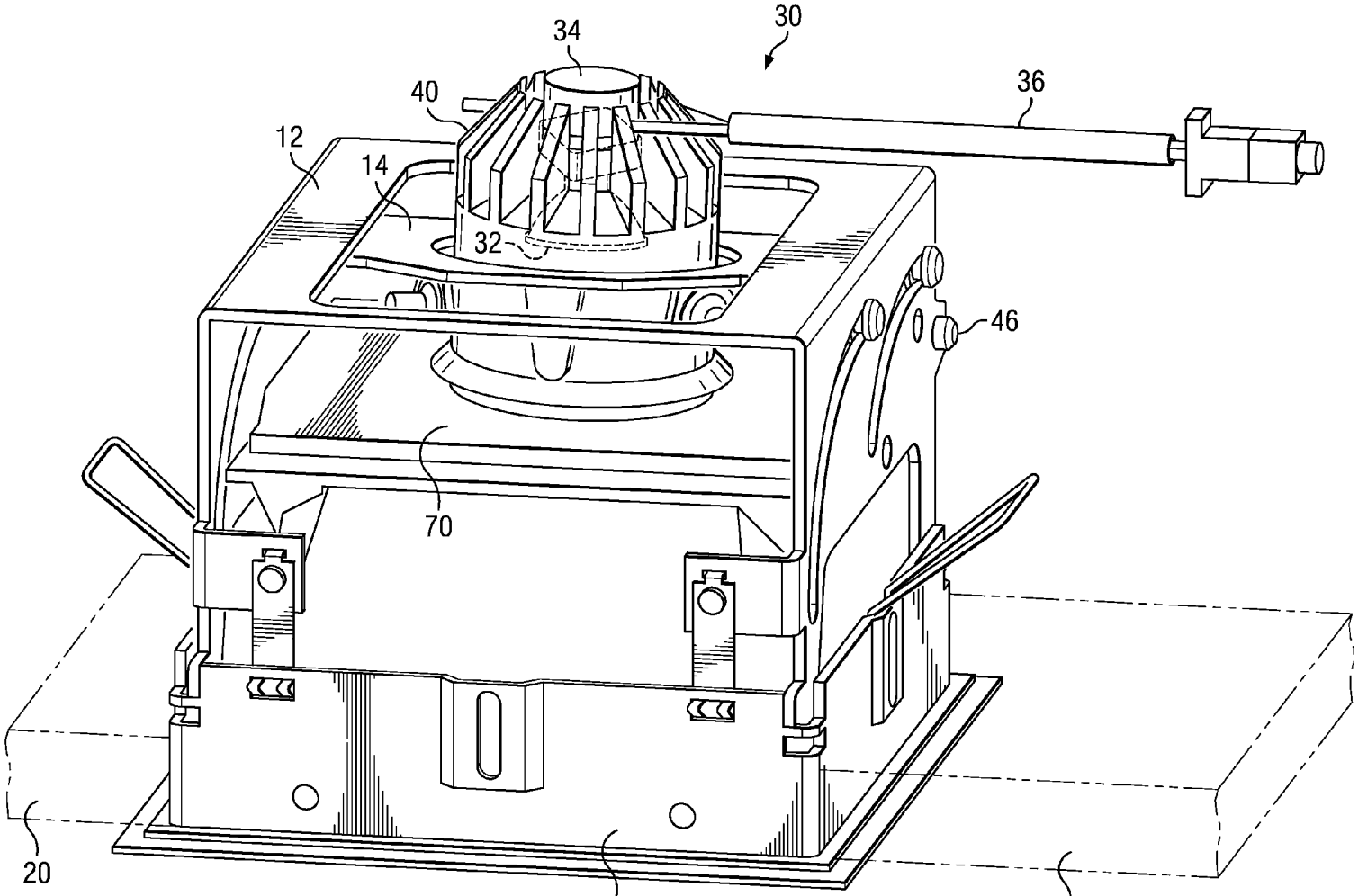
FIG. 4 illustrates an example view of the adjustable device for supporting a lamp inside a lamp assembly, which houses the lamp, showing an example lamp assembly connected to the device, according to one example embodiment.

FIGS. 1A-4 illustrate various aspects of an adjustable device 10 for supporting a lamp, according to an example embodiment of the present disclosure. In particular, FIGS. 1A-1C illustrate a three-dimensional view of adjustable device 10 in three different user-selected positions. FIGS. 2A-2C illustrate side views of adjustable device 10 in the three different user-selected positions shown in FIGS. 1A-1C, along a first direction of view. FIGS. 3A-3C illustrate side views of adjustable device 10 in the three different user-selected positions shown in FIGS. 1A-1C, along a second direction of view opposite the first direction of view. Finally, FIG. 4 illustrates an example view of adjustable device 10 with an example lamp attached to the device, according to one example embodiment.

Figure 1B:
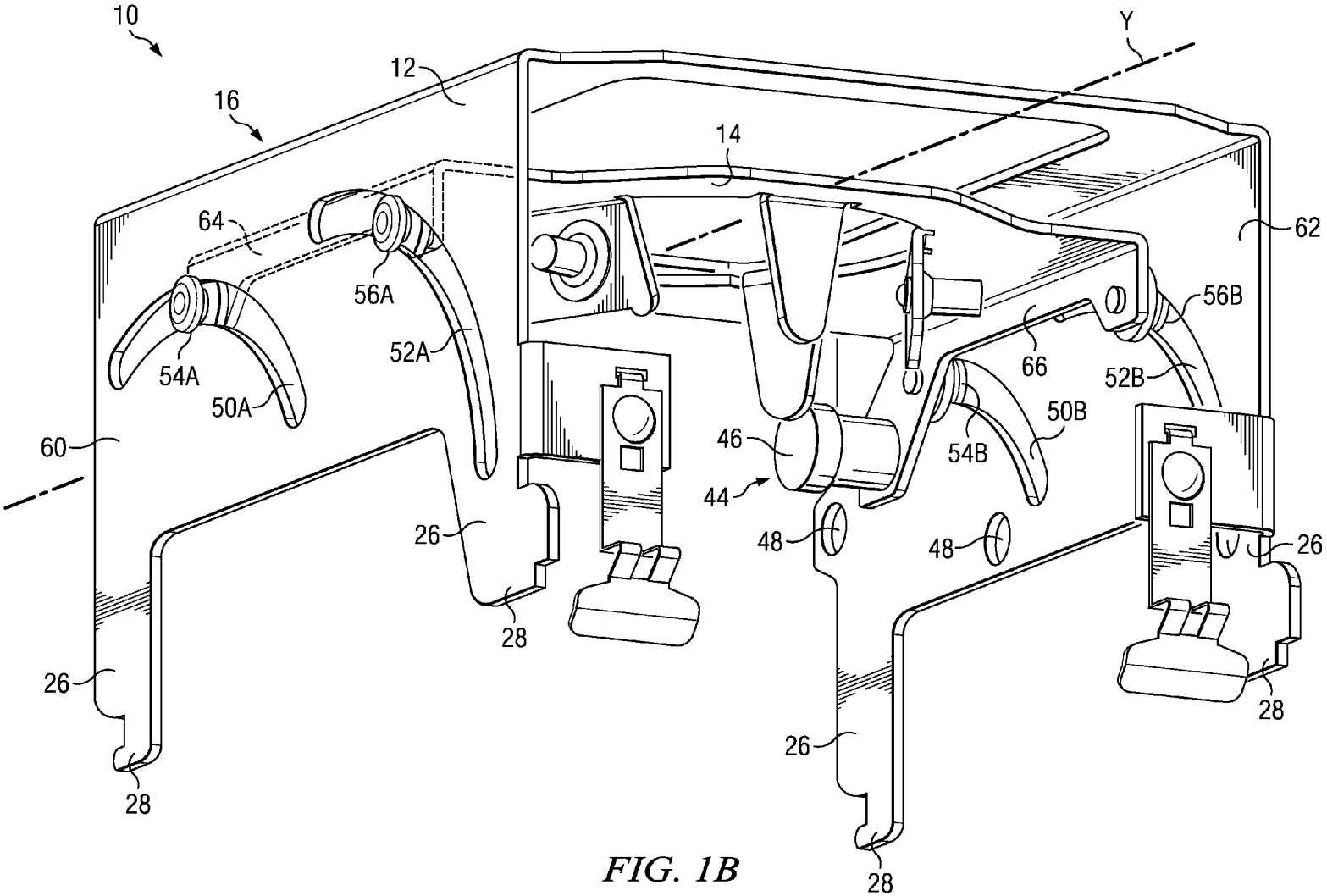
Figure 1C:
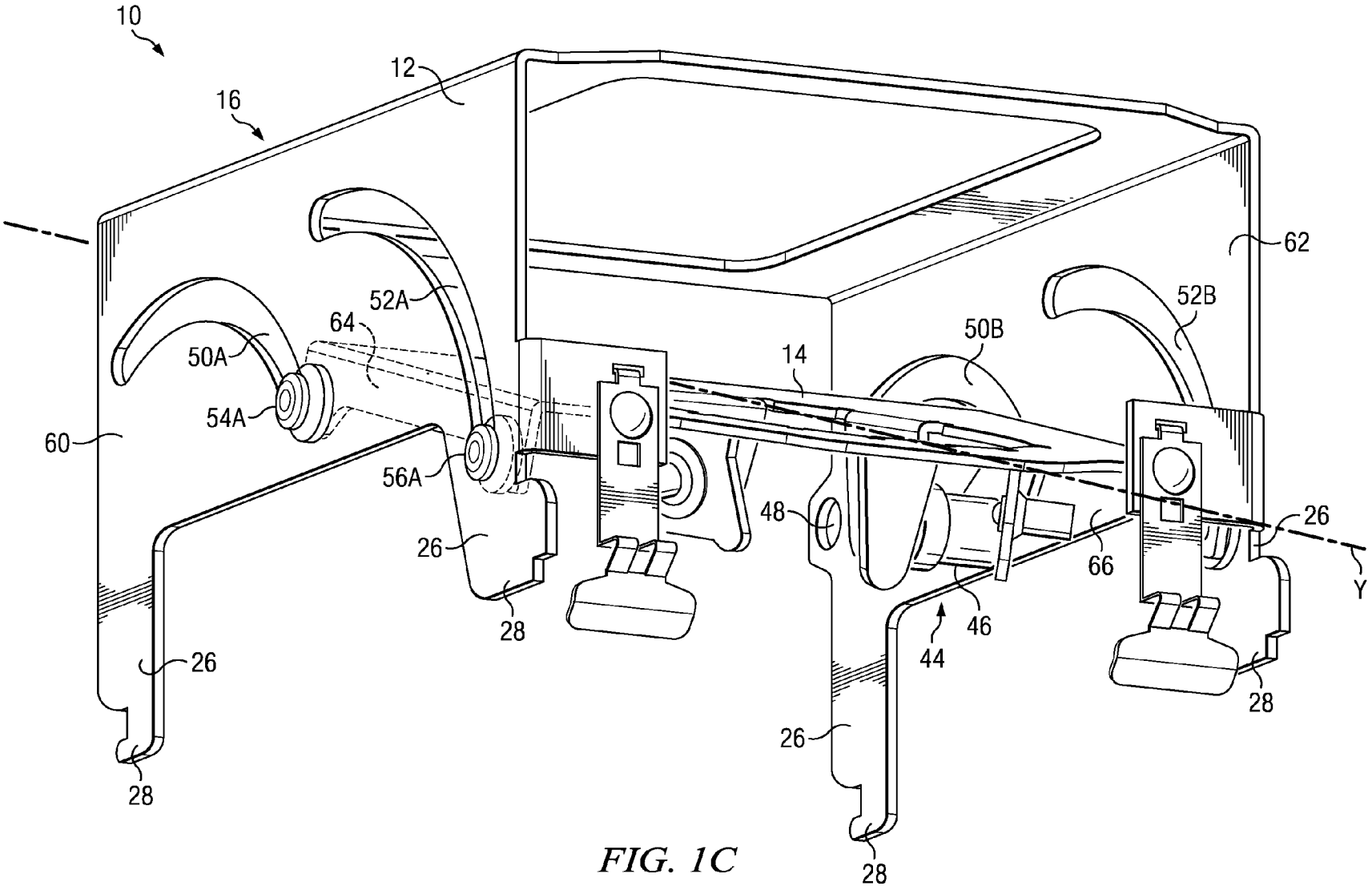

As shown in FIGS. 1A-1C, adjustable device 10 may include a bracket 12, a lamp housing 14, and an adjustment system 16. Bracket 12 may be configured for direct or indirect connection to a substrate 20 (shown in FIGS. 2 and 3), such as a ceiling, wall, or other structure. For example, bracket 12 may coupled to a main housing structure, which is connected to a ceiling joist or other structural member. As another example, bracket 12 may be coupled indirectly to substrate 20 using a trim or mounting collar 24 (shown in FIG. 4) or any other suitable mounting elements. In the illustrated example, bracket 12 includes legs 26 with feet 28 configured to engage with corresponding features of mounting collar 24 to removably couple bracket 12 to mounting collar 24.

Lamp housing 14 is configured to support a lamp assembly 30 (shown in FIG. 4). Lamp assembly 30 may include a lamp 32, a socket 34 for connecting lamp 32 to an electrical supply 36, and a lamp holder 40 configured to hold lamp 32 and socket 34 in lamp housing 14. Lamp 32 may include any suitable type of lamp or bulb (or multiple lamps or bulbs), e.g., LED, incandescent, ceramic metal halide, etc. In one embodiment, lamp 32 is a MR16-type lamp. Socket 34 may include any socket or connection element for electrically connecting lamp 32 to an electrical supply 36.

A reflector 70 (or multiple reflectors) may be coupled to lamp assembly 30. In some embodiments, different sized and/or shaped reflectors may be attached to lamp assembly 30 and/or mounting collar 24 depending on the adjusted position of lamp housing 14. In other embodiments, a single reflector 70 may be used for all adjusted position of lamp housing 14, such that reflector 70 rotates or otherwise moves with lamp assembly 30 as lamp housing 14 moves between different positions relative to bracket 12, as discussed below. In other embodiments, reflector 70 is secured to mounting collar 24 such that reflector 70 remains unmoved as lamp housing 14 moves between different positions relative to bracket 12. An example reflector is shown in FIG. 4.

Lamp holder 40 may be supported by and/or coupled to lamp housing 14 in any suitable manner (e.g., permanently or removably), using any suitable coupling elements. As discussed in greater detail below, lamp housing 14 is configured for movement between different angular orientations relative to bracket 12. In some embodiments, lamp housing 14 secures lamp holder 40 in a constant position relative to lamp housing 14, such that the angular orientation of lamp holder 40 relative to bracket 12 changes as lamp housing 14 is moved between different positions relative to bracket 12. Thus, the angle of lamp 32 may be adjusted by adjusting the position of lamp housing 14 relative to bracket 12, e.g., to adjust a wall wash angle or otherwise orient the light emitted by lamp 32 as desired.

Adjustment system 16 adjustably couples lamp housing 14 to bracket 12, and defines a plurality of different selectable positions of lamp housing 14 relative to bracket 12. In some embodiments, adjustment system 16 enables both translation and rotation of lamp housing 14 relative to bracket 12 to move lamp housing 14 between the plurality of selectable positions relative to bracket 12. In some embodiments, adjustment system defines two selectable positions of lamp housing 14. In other embodiments, e.g., the example embodiment illustrated in FIGS. 1A-4, adjustment system 16 defines three selectable positions of lamp housing 14. In other embodiments, e.g., the example embodiment illustrated in FIGS. 1A-4, adjustment system 16 defines more than three selectable positions of lamp housing 14 (e.g., four positions, five positions, or more). In still other embodiments, adjustment system 16 allows lamp housing 14 to be adjusted between an infinite number of positions.

In some embodiments, e.g., the example embodiment illustrated in FIGS. 1A-4, adjustment system 16 may include a locking system 44 to secure lamp housing 14 in each of the selectable positions relative to bracket 12. For example, locking system 44 may include one or more spring-biased locking elements 46 configured to engage with a number of openings, slots 48, or other locking position structures corresponding to the multiple different selectable positions of lamp housing 14. Any other suitable locking mechanisms may be used in other embodiments.

In some embodiments, adjustment system 16 may include at least two elongated curved guide structures provided by one of bracket 12 and lamp housing 14, and at least two guide elements provided by the other one of bracket 12 and lamp housing 14, with each guide element being slidably engaged with one of the elongated curved guide structures. Movement of the guide elements along the elongated curved guide structures causes lamp housing 14 to simultaneously translate and rotate relative to bracket 12 to position lamp housing 14 in any of the multiple different selectable positions relative to bracket 12.

For example, in the embodiment shown in FIGS. 1A-4, adjustment system 16 includes:

(a) a first pair of elongated curved guide slots 50A and 52A formed in a first lateral side 60 of bracket 12;

(b) a second pair of elongated curved guide slots 50B and 52B formed in a second lateral side 62 of bracket 12;

(c) a first pair of guide elements 54A and 56A integral with or coupled to a first lateral side 64 of lamp housing 14;

(d) a second pair of guide elements 54B and 56B integral with or coupled to a second lateral side 66 of lamp housing 14;

(e) a hand-controllable spring-biased locking element 46 coupled to lamp housing 14; and (f) a number of slots 48 formed in bracket 12 for receiving locking element 46.

As shown, guide elements 54A and 56A are guided within guide slots 50A and 52A, respectively, and guide elements 54B and 56B are guided within guide slots 50B and 52B, respectively, allowing lamp housing 14 to slide between different positions relative to bracket 12. In this example, bracket 12 includes three slots 48 for receiving locking element 46, thus defining three selectable positions for lamp housing 14.

As shown in FIGS. 2A and 3A, guide slots 50A and 50B define a first radius of curvature R1, while guide slots 52A and 52B define a second radius of curvature R2 greater than the first radius of curvature R1. Further, guide slots 50A and 50B define a first length of travel L1, while guide slots 52A and 52B define a second length of travel L2 longer than the first length of travel L1, such that during adjustment of lamp housing 14 relative to bracket 12, the guide elements 56A and 56B travel further than guide elements 54A and 54B. In other embodiments, the second radius of curvature R2 may be equal to or less than the first radius of curvature R1, and/or the second length of travel L2 may be equal to or shorter than the first length of travel L1.

As discussed above, adjustment system 16 of the illustrated embodiment defines three selectable positions for lamp housing 14. FIGS. 1A, 2A, and 3A illustrate the first selectable position of lamp housing 14, in which the longitudinal axis X of lamp holder 40 is offset from the perpendicular direction P in a first direction by a first angle $\alpha 1$. FIGS. 1B, 2B, and 3B illustrate the second selectable position of lamp housing 14, in which a longitudinal axis X of lamp holder 40 supported by lamp housing 14 extends in a perpendicular direction P relative to substrate 20 to which bracket 12 is coupled. Finally, FIGS. 1C, 2C, and 3C illustrate the third selectable position of lamp housing 14, in which the longitudinal axis X of lamp holder 40 is offset from the perpendicular direction P in a second direction by a second angle $\alpha 2$. First angle $\alpha 1$ may be the same as, greater than, or less than, second angle $\alpha 2$. In other embodiments, adjustment system 16 may define more than one selectable position being offset from the perpendicular direction P in the same direction, by different angles. For example, an embodiment may be similar to the illustrated embodiment, but with one or more additional positions at different angular offsets in the first direction and/or the second direction with respect to the perpendicular direction P.

In the illustrated embodiment, guide slots 50A and 52A correspond in shape and size to guide slots 50B and 52B, respectively, and are located at corresponding positions with respect to lateral sides 60 and 62 of bracket 12. Further, lateral sides 60 and 62 of bracket 12 are each planar, parallel to each other, perpendicular to substrate 20. Thus, in the illustrated embodiment, lamp housing 14—and thus longitudinal axis A of lamp 34—does not rotate relative to a longitudinal axis Y of bracket 12, shown in FIG. 1A.

In other embodiments, lamp housing 14—and thus longitudinal axis A of lamp holder 40—does rotate relative to a longitudinal axis Y. Such rotation may be provided in any suitable manner. For example, one or both of guide slots 50A and 52A may differ in shape and/or size from guide slots 50B and 52B, respectively. As another example, one or both of guide slots 50A and 52A may be located in different locations than guide slots 50B and 52B, with respect to lateral sides 60 and 62 of bracket 12. As another example, one or both of lateral sides 60 and 62 of bracket 12 may be non-planar, non-perpendicular to substrate 20, or lateral sides 60 and 62 may be non-parallel to each other. In any of such embodiments in which lamp housing 14—and thus longitudinal axis A of lamp holder 40—rotates relative to a longitudinal axis Y, different selectable positions of lamp housing 14 may allow for adjustment of longitudinal axis A of lamp holder 40 in more than one plane (e.g., in two orthogonal directions).

As discussed above, adjustment system 16 may include at least two elongated curved guide structures provided by one of bracket 12 and lamp housing 14, and at least two guide elements provided by the other one of bracket 12 and lamp housing 14, with each guide element being slidably engaged with one of the elongated curved guide structures. Also as discussed above, in the illustrated embodiment, the elongated curved guide structures comprise guide slots formed in bracket 12, and the guide elements are protruding structures formed integral with or coupled to lamp housing 14. However, in other embodiments, the guide elements comprises slots, while the elongated curved guide structures comprise elongated curved protrusions slidably received in the slots. Further, in some embodiments, the elongated curved guide structures (e.g., slots or elongated curved protrusions) the elongated curved guide structures are formed in or coupled to lamp housing 14, while the guide elements (e.g., protruding structures or slots) are integral with or coupled to bracket 12.

FIGS. 5A-7B illustrate various examples of a lighting apparatus 100A-100C having a lamp that is accessible from an area outside the room that the lighting apparatus is used to light (e.g., from above the ceiling or outside the wall in which the lighting apparatus is installed), according to example embodiments of the present disclosure. Such lighting apparatuses in which the lamp is accessible from an area outside the room are referred to herein as "top-accessible."

Figure 5A:
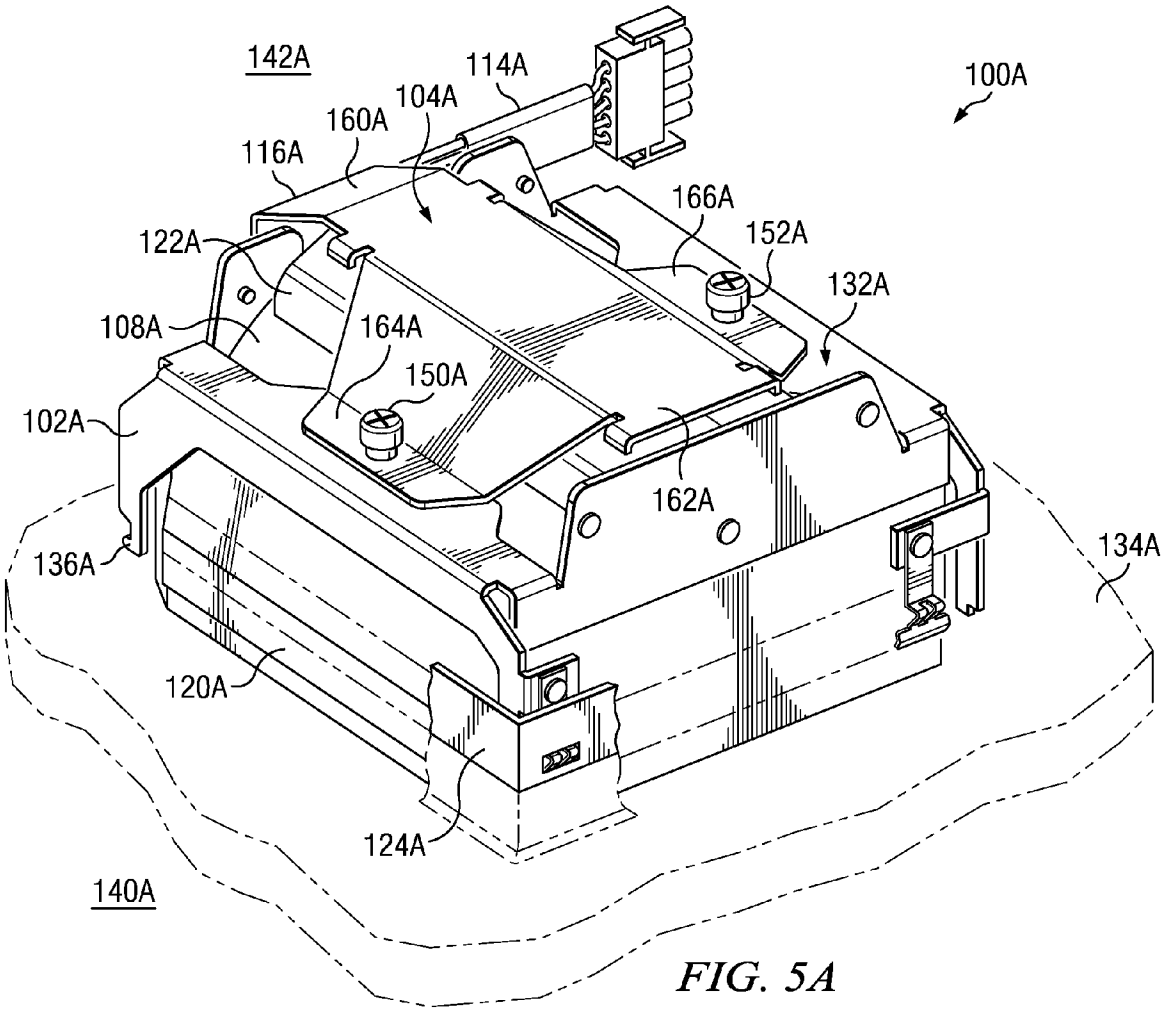
FIGS. 5A and 5B illustrate non-accessed (i.e., operational) and accessed positions, respectively, of a first example top-accessible lighting apparatus having a moveable or removable access portion for providing access to a lamp, according to one example embodiment.
Figure 5B:
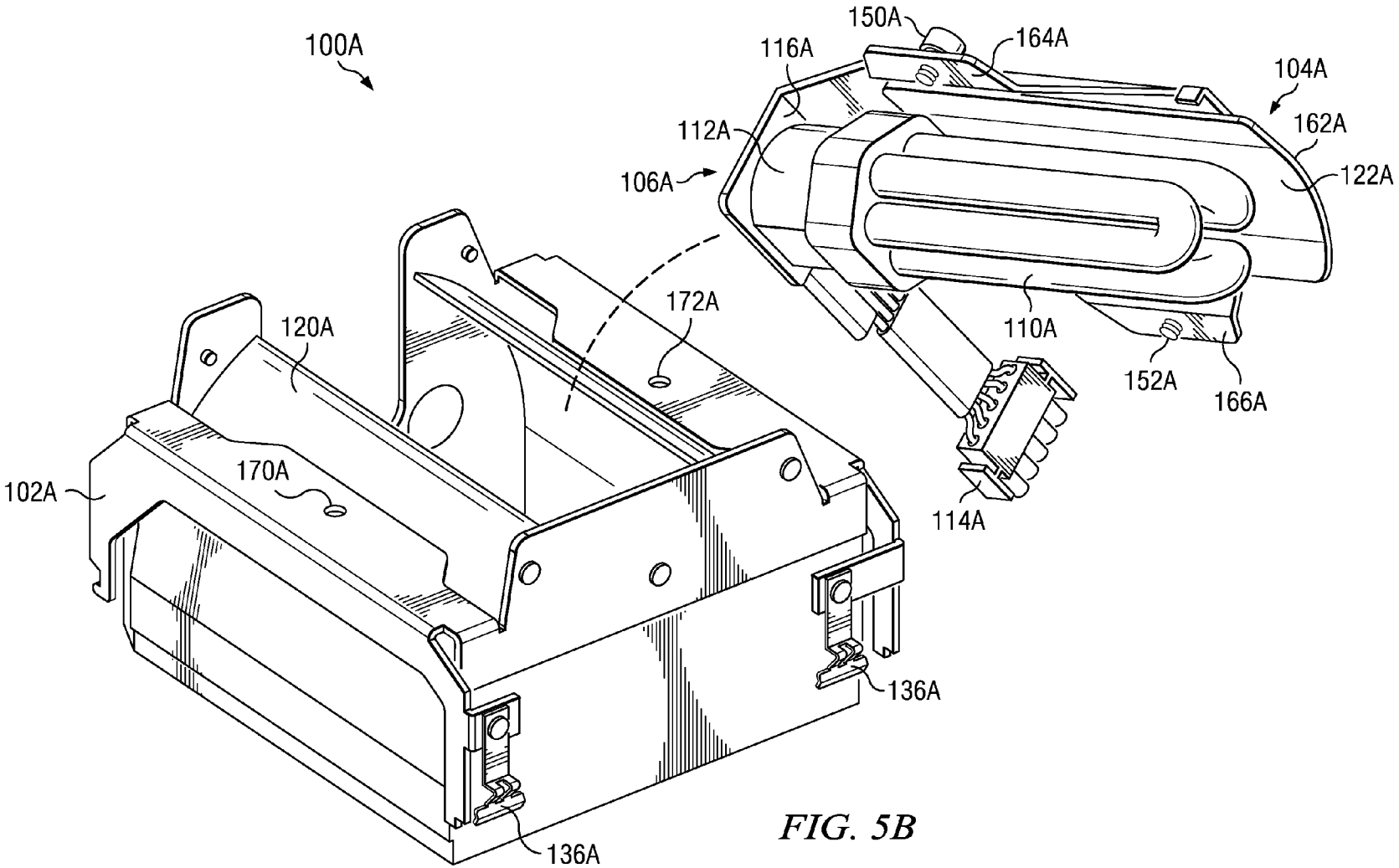
Figure 6A:
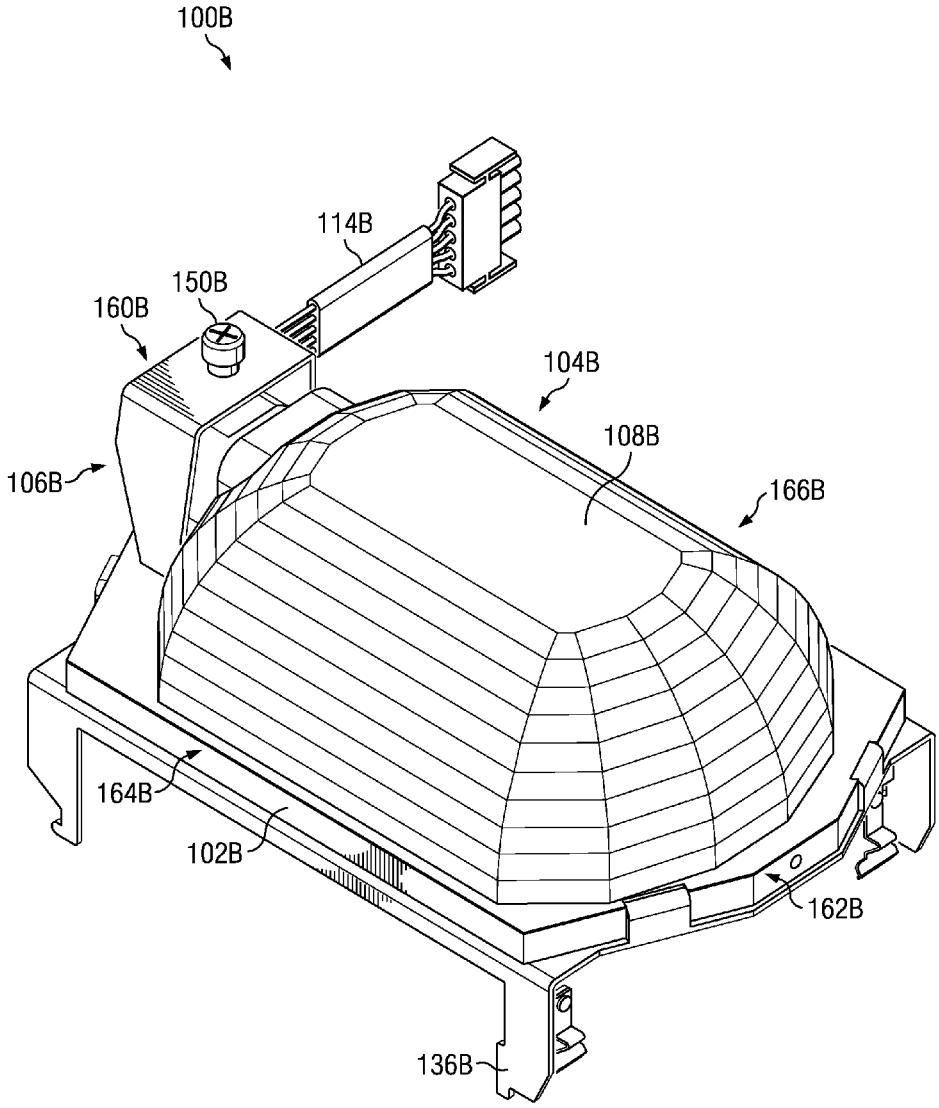
FIGS. 6A and 6B illustrate non-accessed (i.e., operational) and accessed positions, respectively, of a second example top-accessible lighting apparatus having a moveable or removable access portion for providing access to a lamp, according to one example embodiment.
Figure 6B:
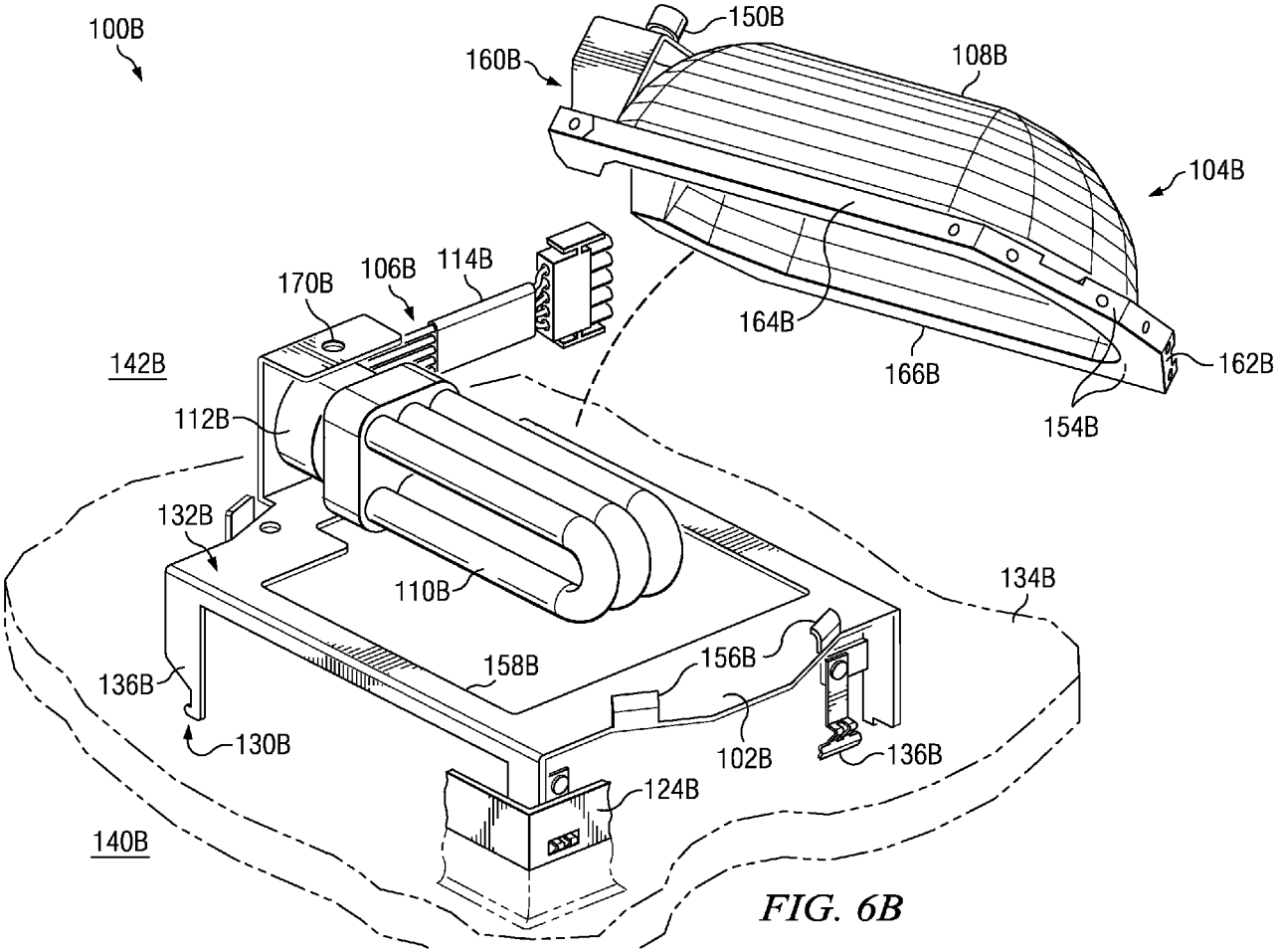
Figure 7A:
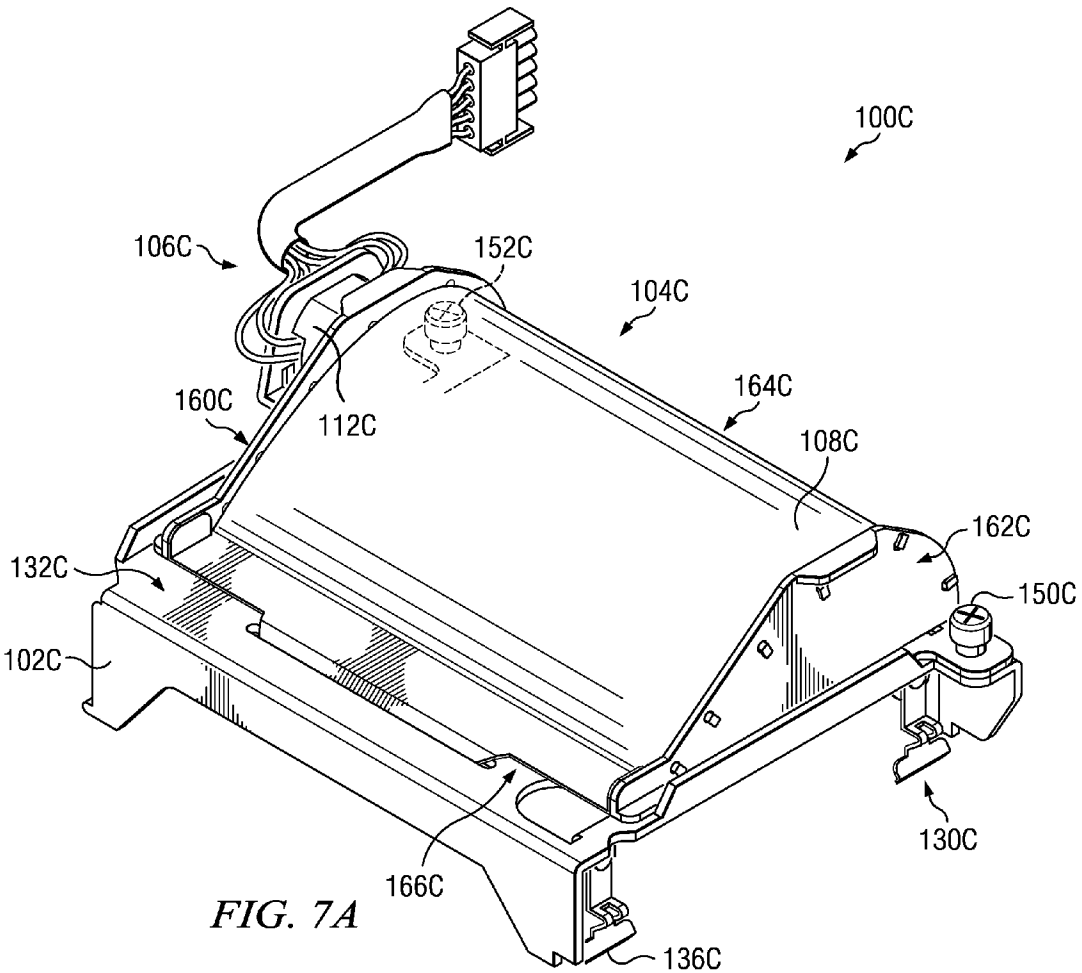
FIGS. 7A and 7B illustrate non-accessed (i.e., operational) and accessed positions, respectively, of a third example top-accessible lighting apparatus having a moveable or removable access portion for providing access to a lamp, according to one example embodiment.
Figure 7B:
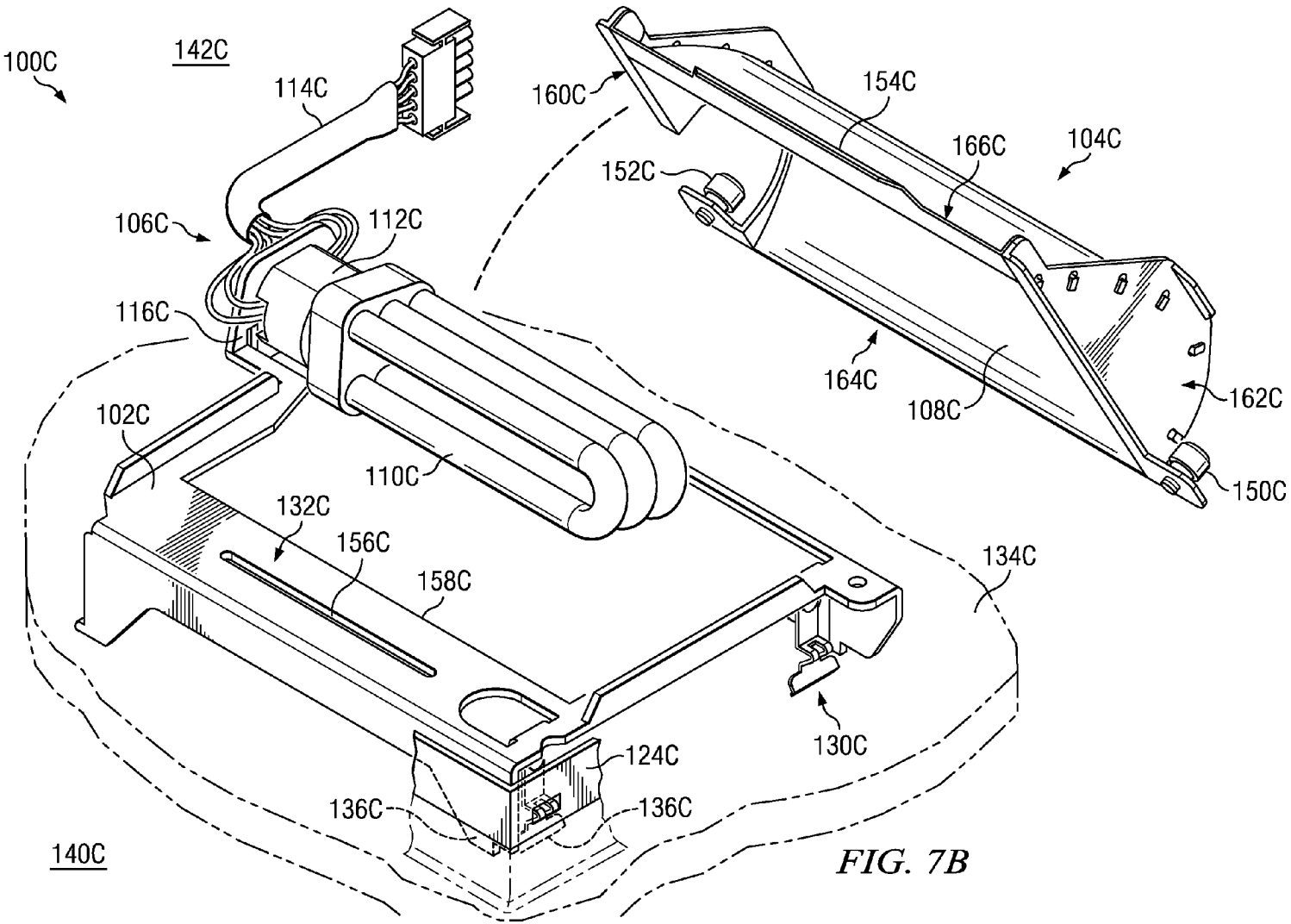

FIGS. 5A and 5B illustrate an example embodiment of a top-accessible lighting apparatus 100A having a moveable or removable access portion for providing access to the lamp, in which the moveable or removable access portion includes only a portion of a reflector for the lamp. FIGS. 6A and 6B illustrate an example embodiment of a top-accessible lighting apparatus 100B in which the full reflector for the lamp is carried on the moveable or removable access portion for providing access to the lamp. FIGS. 7A and 7B illustrate another example embodiment of a top-accessible lighting apparatus 100C in which the full reflector for the lamp is carried on the moveable or removable access portion for providing access to the lamp.

Referring first to FIGS. 5A and 5B, FIG. 5A shows example lighting apparatus 100A in a non-accessed state (e.g., during normal operation of apparatus 100A), while FIG. 5B shows example lighting apparatus 100A in an accessed state (e.g., for relamping or repairing apparatus 100). Lighting apparatus 100A includes a housing 102A, an access portion 104A, a lamp assembly 106A, and a reflector 108A.

Lamp assembly 106A may be integral with or coupled to access portion 104A such that access portion 104A and lamp assembly 106A are movably or removably coupled to housing 102A as a unit, as shown in FIG. 5B.

Lamp assembly 106A may include a lamp 110A, a socket 112A for connecting lamp 110A to an electrical supply 114A, and a connection structure 116A for coupling socket 112A to the other structures of access portion 104A. Lamp 110A may include any suitable type of lamp or bulb (or multiple lamps or bulbs), e.g., LED, compact florescent, incandescent, etc. Socket 112A may include any socket or connection element for electrically connecting lamp 110A to electrical supply 114A. Connection structure 116A include any suitable connectors or structures for coupling socket 112A to the other structures (e.g., reflector portion 122A) of access portion 104A.

In this embodiment, reflector 108A includes a first reflector portion 120A and a second reflector portion 122A that cooperate to reflect light from lamp 110A into the room in which apparatus 100A is installed, in the non-accessed (i.e., normal operational) state of apparatus 100A shown in FIG. 5A. As best shown in FIG. 5B, first reflector portion 120A is integral with or coupled to housing 102A, whereas second reflector portion 122A is integral with or coupled to access portion 104A such that upon movement of access portion access portion 104A relative to housing 102A (e.g., removal of access portion 104A), second reflector portion is carried by access portion 104A while first reflector portion 120A remains stationary relative to housing 102A.

Housing 102A defines a first side 130A and an opposing second side 132A. The first side 130A of housing 102A may be configured for attachment to a main housing structure or a collar 124A, which may in turn be secured to a substrate 134A, e.g., a ceiling or wall of the room that apparatus 100A is arranged to light, which separates an interior area 140A of the room from an exterior area 142A outside the room. An example substrate 134A is shown in dashed lines in FIG. 5A. In the non-accessed (i.e., normal operational) state of apparatus 100A shown in FIG. 5A, lamp 10A is arranged to emit light through the first side 130A of housing 102A and through an opening in substrate 134A and into the interior area 140A of the room. Housing 102A may connected directly or indirectly to substrate 134A. For example housing 102A may coupled directly to a ceiling joist or other structural member. As another example, housing 102A may be coupled indirectly to substrate 134A using a trim element, mounting bracket, or any other suitable mounting elements. In the illustrated example, housing 102A includes legs 136A configured to engage with corresponding features of a trim element, mounting bracket, or other suitable mounting element.

Access portion 104A is accessible from the exterior area 142A outside the room and movably or removably coupled to housing 102A for movement between (a) a first position shown in FIG. 5A, in which access to lamp 110A from the exterior area 142A is blocked and (b) a second position shown in FIG. 5B access to lamp 110A from the exterior area 142A is provided, such that access portion 104A may be accessed from the exterior area 142A outside the room and moved from the first position to the second position in order to access lamp 110A from the exterior area 142A outside the room. In some embodiments, access portion 104A is removable from housing 104A to provide access to lamp 110A from exterior area 142A, e.g., as shown in FIG. 5B. In other embodiments, access portion 104A may be moved relative to housing 104A, but remains coupled to housing 104A, to provide access to lamp 110A from exterior area 142A. For example, access portion 104A may pivot or rotate relative to housing 104A to provide access to lamp 110A from exterior area 142A. Further, in some embodiments, lighting apparatus 100A may include multiple lamp assemblies 106A or multiple lamps 110A, such that moving access portion 104A from the first position to the second position (e.g., removing or decoupling access portion 104A from housing 104A) provides access to multiple lamp assemblies 106A or multiple lamps 110A.

Access portion 104A may be movably or removably coupled to housing 102A using one or more releasable connectors or in any other suitable manner. In some embodiments, access portion 104A may be moved or removed from housing 102A from both the interior 140A of the room (e.g., via an opening in housing 102A and an opening in substrate 134A) and the exterior area 142A outside the room. In other embodiments, access portion 104A may be moved or removed from housing 102A from the exterior area 142A outside the room, but not from the interior 140A of the room. For example, in the illustrated embodiment, access portion 104A is removably coupled to housing 102A by a pair of releasable connectors 150A and 152A that are accessible from the exterior area 142A, but not from the interior 140A of the room. Releasable connectors 150A and 152A may include any suitable connectors for controlling or allowing movement/removal of access portion 104A. As one example, releasable connectors 150A and 152A are thumbscrews that can be loosed/tightened by hand and/or using a tool (e.g., screwdriver).

As shown in FIGS. 5A and 5B, access portion 104A is generally elongated in a first direction and defines two longitudinal ends 160A and 162A and two lateral sides 164A and 166A. In this embodiment, connectors 150A and 152A are located on both lateral sides 164A and 166A of access portion 104A and screw into threaded holes 170A and 172A formed in opposite sides of housing 102A. In other embodiments, access portion 104A is coupled to housing 102A by connectors 150A and 152A located at longitudinal ends 160A and 162A of access portion 104A. In other embodiments, access portion 104A is coupled to housing 102A by a single releasable connector located at one longitudinal end 160A or 162A, or at one lateral side 164A or 166A.

Referring now to FIGS. 6A and 6B, FIG. 6A shows example lighting apparatus 100B in a non-accessed state (e.g., during normal operation of apparatus 100B, while FIG. 6B shows example lighting apparatus 100B in an accessed state (e.g., for relamping or repairing apparatus 100B). Lighting apparatus 100B includes a housing 102B, an access portion 104B, a lamp assembly 106B, and a reflector 108B. Unlike the embodiment of FIGS. 5A and 5B, in this embodiment lamp assembly 106B may be integral with or coupled to housing 102B such that access portion 104B remains stationary relative to housing 102B when lamp assembly 106B is moved or removed from housing 102B, as shown in FIG. 6B.

Lamp assembly 106B may include a lamp 110B, a socket 112B for connecting lamp 110B to an electrical supply 114B, and a connection structure 116B for coupling socket 112B to housing 102B. Lamp 110B may include any suitable type of lamp or bulb (or multiple lamps or bulbs), e.g., LED, compact florescent, incandescent, etc. Socket 112B may include any socket or connection element for electrically connecting lamp 110B to electrical supply 114B. Connection structure 116B include any suitable connectors or structures for coupling socket 112B to housing 102B.

Reflector 108B may be configured to reflect light from lamp 110B into the room in which apparatus 100B is installed, in the non-accessed (i.e., normal operational) state of apparatus 100B shown in FIG. 6A. As best shown in FIG. 6B, the full reflector 108B is integral with or coupled to access portion 104B such that the full reflector 108B is carried by access portion 104B upon movement or removal of access portion access portion 104B relative to housing 102B.

Housing 102B defines a first side 130B and an opposing second side 132B. The first side 130B of housing 102B may be configured for attachment to a main housing structure or a collar 124B, which may in turn be secured to a substrate 134B, e.g., a ceiling or wall of the room that apparatus 100B is arranged to light, which separates an interior area 140B of the room from an exterior area 142B outside the room. An example substrate 134B is shown in dashed lines in FIG. 6B. In the non-accessed (i.e., normal operational) state of apparatus 100B shown in FIG. 6A, lamp 10B is arranged to emit light through the first side 130B of housing 102B and through an opening in substrate 134B and into the interior area 140B of the room. Housing 102B may connected directly or indirectly to substrate 134B. For example housing 102B may coupled directly to a ceiling joist or other structural member. As another example, housing 102B may be coupled indirectly to substrate 134B using a trim element, mounting bracket, or any other suitable mounting elements. In the illustrated example, housing 102B includes legs 136B configured to engage with corresponding features of a trim element, mounting bracket, or other suitable mounting element.

Access portion 104B is accessible from the exterior area 142B outside the room and movably or removably coupled to housing 102B for movement between (a) a first position shown in FIG. 6A, in which access to lamp 110B from the exterior area 142B is blocked and (b) a second position shown in FIG. 6B access to lamp 110B from the exterior area 142B is provided, such that access portion 104B may be accessed from the exterior area 142B outside the room and moved from the first position to the second position in order to access lamp 110B from the exterior area 142B outside the room. In some embodiments, access portion 104B is removable from housing 104B to provide access to lamp 110B from exterior area 142B, e.g., as shown in FIG. 6B. In other embodiments, access portion 104B may be moved relative to housing 104B, but remains coupled to housing 104B, to provide access to lamp 110B from exterior area 142B. For example, access portion 104B may pivot or rotate relative to housing 104B to provide access to lamp 110B from exterior area 142B.

Further, in some embodiments, lighting apparatus 100B may include multiple lamp assemblies 106B or multiple lamps 110B, such that moving access portion 104B from the first position to the second position (e.g., removing or decoupling access portion 104B from housing 104B) provides access to multiple lamp assemblies 106B or multiple lamps 110B.

Access portion 104B may be movably or removably coupled to housing 102B using one or more releasable connectors or in any other suitable manner. In some embodiments, access portion 104B may be moved or removed from housing 102B from both the interior 140B of the room (e.g., via an opening 158B in housing 102B and an opening in substrate 134B) and the exterior area 142B outside the room. In other embodiments, access portion 104B may be moved or removed from housing 102B from the exterior area 142B outside the room, but not from the interior 140B of the room.

In the illustrated embodiment, access portion 104B is generally elongated in a first direction and defines two longitudinal ends 160B and 162B and two lateral sides 164B and 166B. In this embodiment, access portion 104B is removably coupled to housing 102B by (a) a single thumbscrew 150B located at longitudinal end 160B and (b) a pair of flanges 154B configured to engage a corresponding pair of clips 156B located proximate longitudinal end 162B, as shown in FIG. 6B. Clips 156B may be formed integral with bracket 102B, or may be separate components from bracket 102B. To remove access portion 104B, the thumbscrew 150B is loosened, which frees the longitudinal end 160B of access portion 104B from housing 102B. Access portion 104B is then lifted in a rotated manner by lifting end 160B of access portion 104B upwardly, which allows flanges 154B to slide out from under clips 156B, thus fully freeing access portion 104B from housing 102B. In this embodiment, thumbscrew 150B is accessible from the exterior area 142B, but not from the interior 140B of the room, such that access portion 104B can only be removed from housing 102B from the exterior area 142B. In other embodiments, thumbscrew 150B may also be accessible from the interior 140B to allow removal of access portion 104B from the interior 140B of the room (e.g., via opening 158B in housing 102B and a corresponding opening in substrate 134B).

In other embodiments, access portion 104B is removably coupled to housing 102B by (a) one or more thumbscrews 150B located at one lateral side 164B or 166B of housing 102B, and (b) one or more flanges 154B configured to engage one or more corresponding clips 156B located proximate the other lateral side 166B or 164B of housing 102B. It should be understood that any other system of one or more connectors (e.g., thumbscrews, flanges, clips, etc.) may be used to movably or removably coupled access portion 104B to housing 102B.

Referring now to FIGS. 7A and 7B, FIG. 7A shows example lighting apparatus 100C in a non-accessed state (e.g., during normal operation of apparatus 100C, while FIG. 7B shows example lighting apparatus 100C in an accessed state (e.g., for relamping or repairing apparatus 100C). Lighting apparatus 100C includes a housing 102C, an access portion 104C, a lamp assembly 106C, and a reflector 108C. Like the embodiment of FIGS. 6A and 6B, in this embodiment lamp assembly 106C may be integral with or coupled to housing 102C such that access portion 104C remains stationary relative to housing 102C when lamp assembly 106C is moved or removed from housing 102C, as shown in FIG. 7B.

Lamp assembly 106C may include a lamp 110C, a socket 112C for connecting lamp 110C to an electrical supply 114C, and a connection structure 116C for coupling socket 112C to housing 102C. Lamp 110C may include any suitable type of lamp or bulb (or multiple lamps or bulbs), e.g., LED, compact florescent, incandescent, etc. Socket 112C may include any socket or connection element for electrically connecting lamp 110C to electrical supply 114C. Connection structure 116C include any suitable connectors or structures for coupling socket 112C to housing 102C.

Reflector 108C may be configured to reflect light from lamp 110C into the room in which apparatus 100C is installed, in the non-accessed (i.e., normal operational) state of apparatus 100C shown in FIG. 7A. As best shown in FIG. 7B, the full reflector 108C is integral with or coupled to access portion 104C such that the full reflector 108C is carried by access portion 104C upon movement or removal of access portion access portion 104C relative to housing 102C.

Housing 102C defines a first side 130C and an opposing second side 132C. The first side 130C of housing 102C may be configured for attachment to a main housing structure of a collar 124C, which may in turn be secured to a substrate 134C, e.g., a ceiling or wall of the room that apparatus 100C is arranged to light, which separates an interior area 140C of the room from an exterior area 142C outside the room. An example substrate 134C is shown in dashed lines in FIG. 7B. In the non-accessed (i.e., normal operational) state of apparatus 100C shown in FIG. 7A, lamp 110C is arranged to emit light through the first side 130C of housing 102C and through an opening in substrate 134C and into the interior area 140C of the room. Housing 102C may connected directly or indirectly to substrate 134C. For example housing 102C may coupled directly to a ceiling joist or other structural member. As another example, housing 102C may be coupled indirectly to substrate 134C using a trim element, mounting bracket, or any other suitable mounting elements. In the illustrated example, housing 102C includes legs 136C configured to engage with corresponding features of a trim element, mounting bracket, or other suitable mounting element.

Access portion 104C is accessible from the exterior area 142C outside the room and movably or removably coupled to housing 102C for movement between (a) a first position shown in FIG. 7A, in which access to lamp 110C from the exterior area 142C is blocked and (b) a second position shown in FIG. 7B access to lamp 110C from the exterior area 142C is provided, such that access portion 104C may be accessed from the exterior area 142C outside the room and moved from the first position to the second position in order to access lamp 110C from the exterior area 142C outside the room. In some embodiments, access portion 104C is removable from housing 104C to provide access to lamp 110C from exterior area 142C, e.g., as shown in FIG. 7B. In other embodiments, access portion 104C may be moved relative to housing 104C, but remains coupled to housing 104C, to provide access to lamp 110C from exterior area 142C. For example, access portion 104C may pivot or rotate relative to housing 104C to provide access to lamp 110C from exterior area 142C.

Further, in some embodiments, lighting apparatus 100C may include multiple lamp assemblies 106C or multiple lamps 110C, such that moving access portion 104C from the first position to the second position (e.g., removing or decoupling access portion 104C from housing 104C) provides access to multiple lamp assemblies 106C or multiple lamps 110C.

Access portion 104C may be movably or removably coupled to housing 102C using one or more releasable connectors or in any other suitable manner. In some embodiments, access portion 104C may be moved or removed from housing 102C from both the interior 140C of the room (e.g., via an opening 158C in housing 102C and an opening in substrate 134C) and the exterior area 142C outside the room. In other embodiments, access portion 104C may be moved or removed from housing 102C from the exterior area 142C outside the room, but not from the interior 140C of the room.

In the illustrated embodiment, access portion 104C defines two longitudinal ends 160C and 162C and two lateral sides 164C and 166C. In this embodiment, access portion 104C is removably coupled to housing 102C by (a) a pair of thumbscrews 150C and 152C located proximate corners at one lateral side 164C and (b) a flange 154C configured to engage a corresponding slot 156C located proximate the other lateral side 166C. To remove access portion 104C, the thumbscrews 150C and 152C are loosened, which frees the lateral side 164C of access portion 104C from housing 102C. Access portion 104C is then lifted in a rotated manner by lifting lateral side 164C upwardly, which allows flange 154C to slide out from slot 156C, thus fully freeing access portion 104C from housing 102C. In this embodiment, thumbscrews 150C and 152C are accessible from the exterior area 142C, but not from the interior 140C of the room, such that access portion 104C can only be removed from housing 102C from the exterior area 142C. In other embodiments, thumbscrews 150C and 152C may also be accessible from the interior 140C to allow removal of access portion 104C from the interior 140C of the room (e.g., via opening 158C in housing 102C and a corresponding opening in substrate 134C).

In other embodiments, access portion 104C is removably coupled to housing 102C by (a) one or more thumbscrews 150C located at one longitudinal end 160C or 162C of housing 102C, and (b) one or more flanges 154C configured to engage one or more corresponding slots 156C located proximate the other longitudinal end 162C or 160C of housing 102C. It should be understood that any other system of one or more connectors (e.g., thumbscrews, flanges, clips, etc.) may be used to movably or removably coupled access portion 104C to housing 102C.

It should be understood that any of the features or aspects of the illustrated example embodiments shown in FIGS. 5A-7B may be combined in any suitable manner to provide any number of additional embodiments. For example, any of the access portions and/or reflector designs may be combined with any of the connection features or techniques discussed above.

Figure 8:
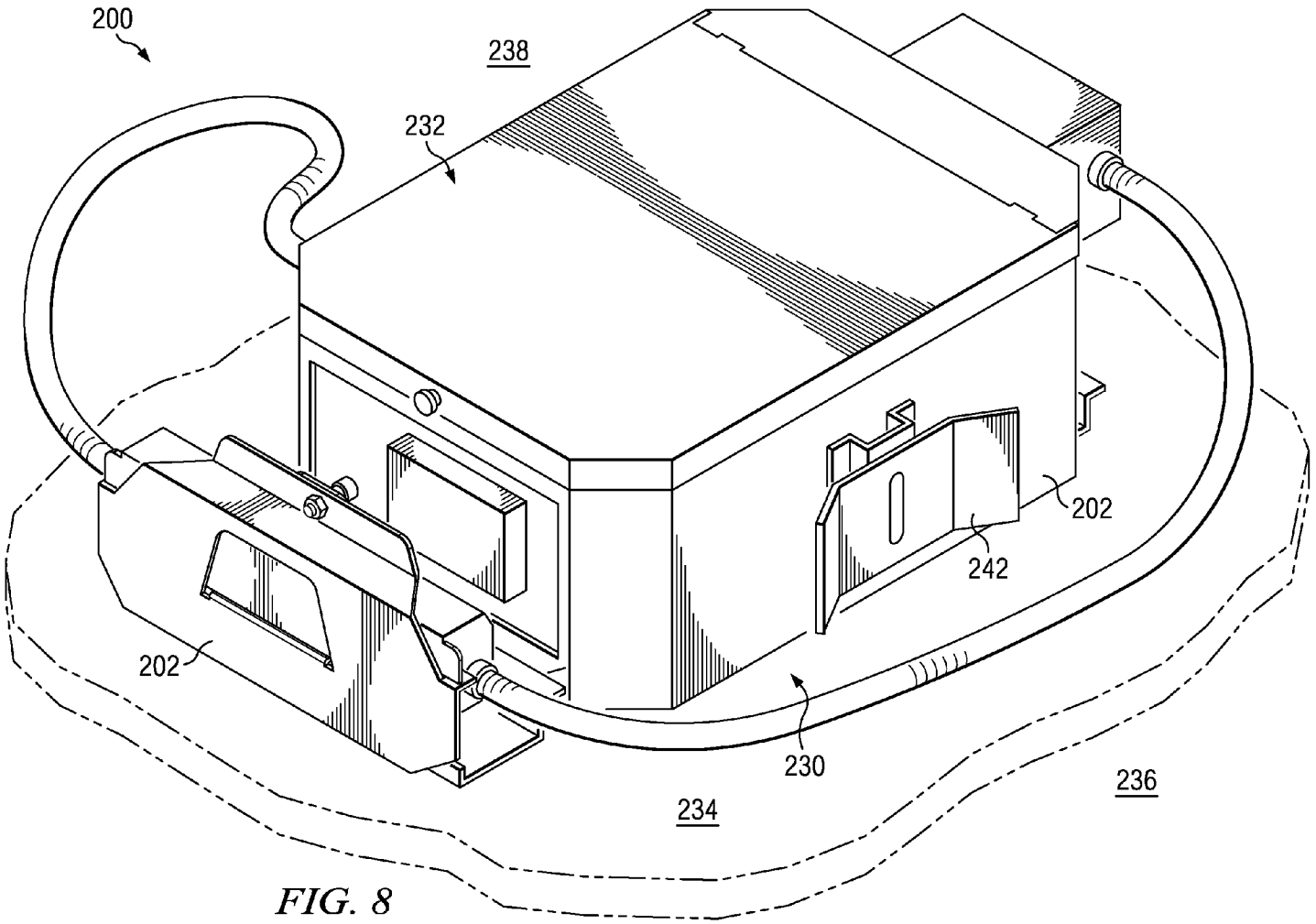
FIGS. 8-13 illustrate various aspects of a lighting system having a housing designed to provide access to an emergency energy source and/or other components, without removing the main housing from the ceiling or wall, according to one example embodiment of the present disclosure.
Figure 9:
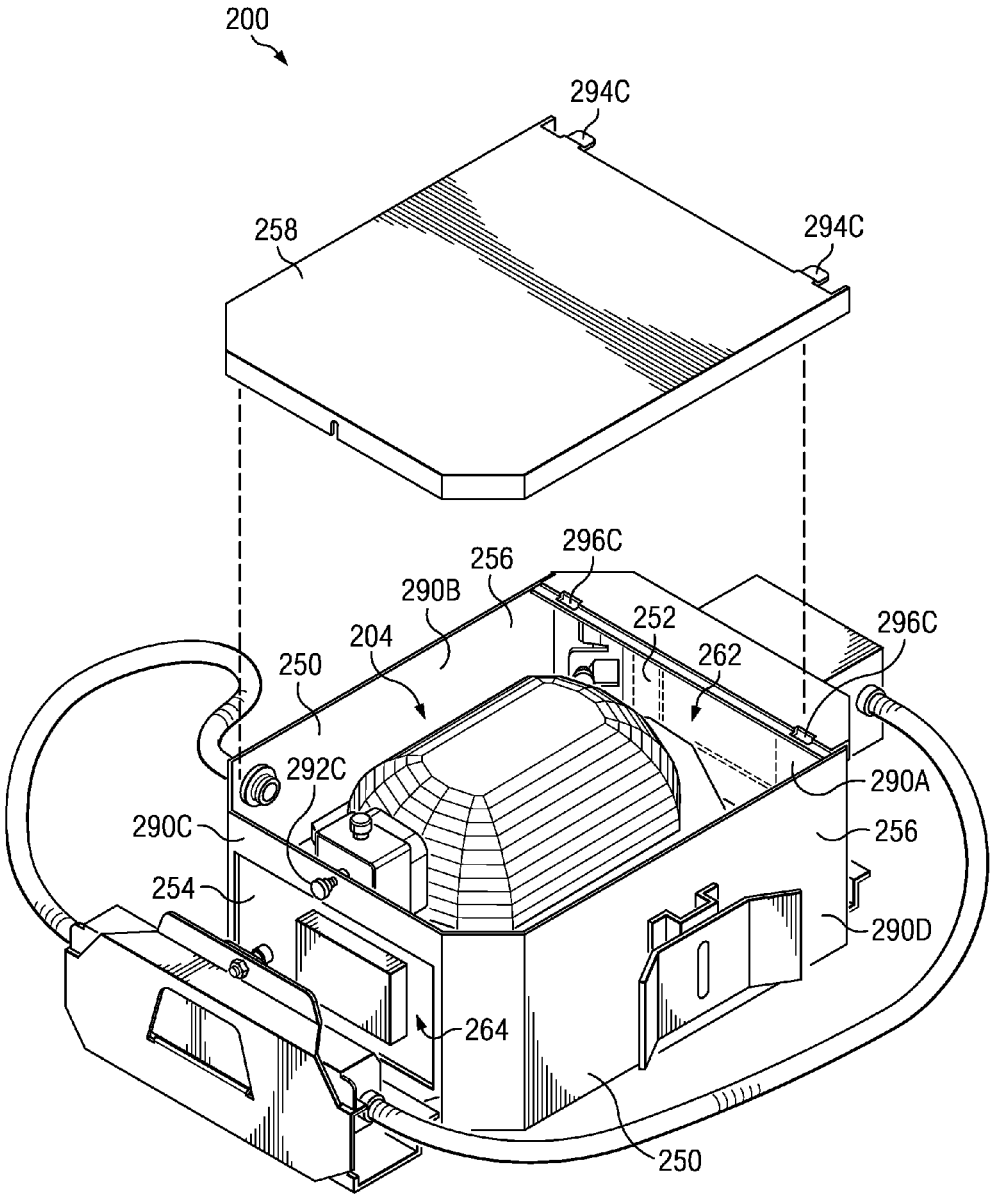
Figure 10:
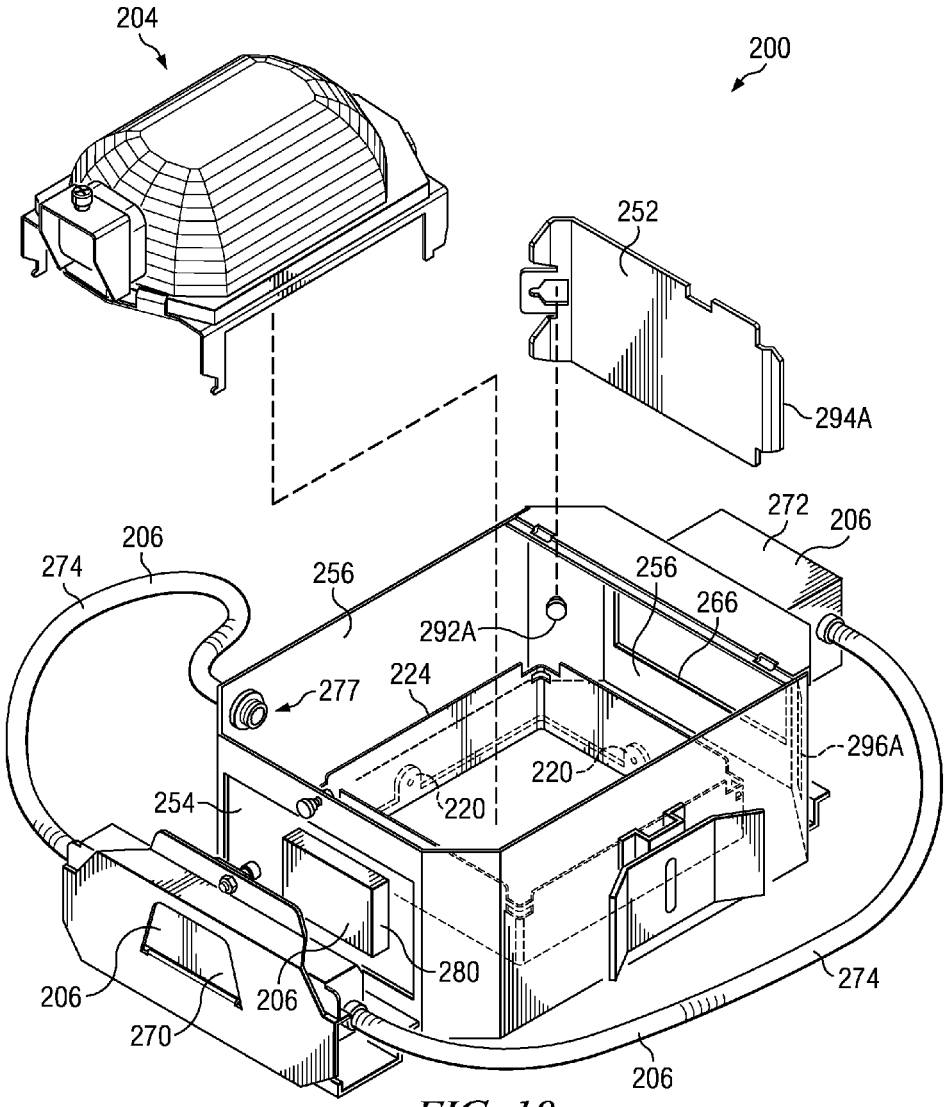
Figure 11:
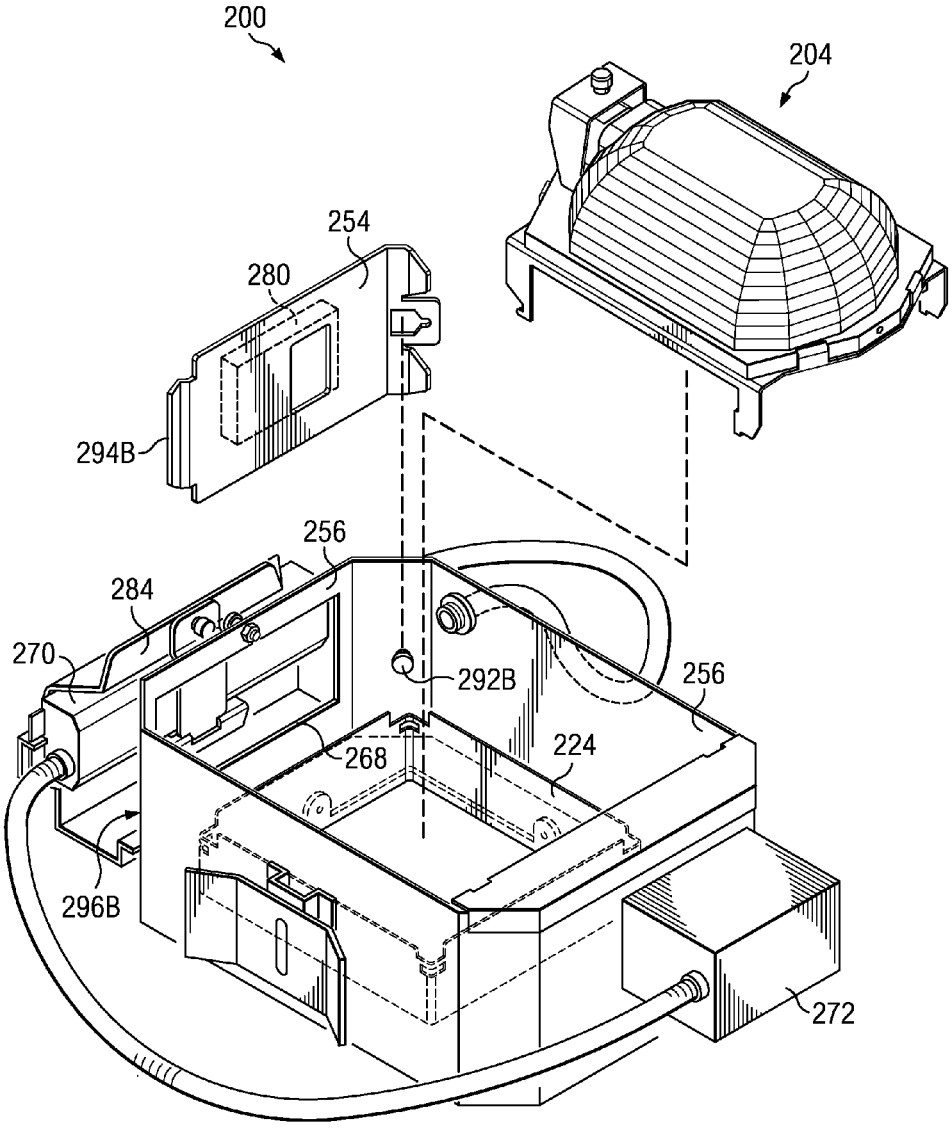
Figure 12:
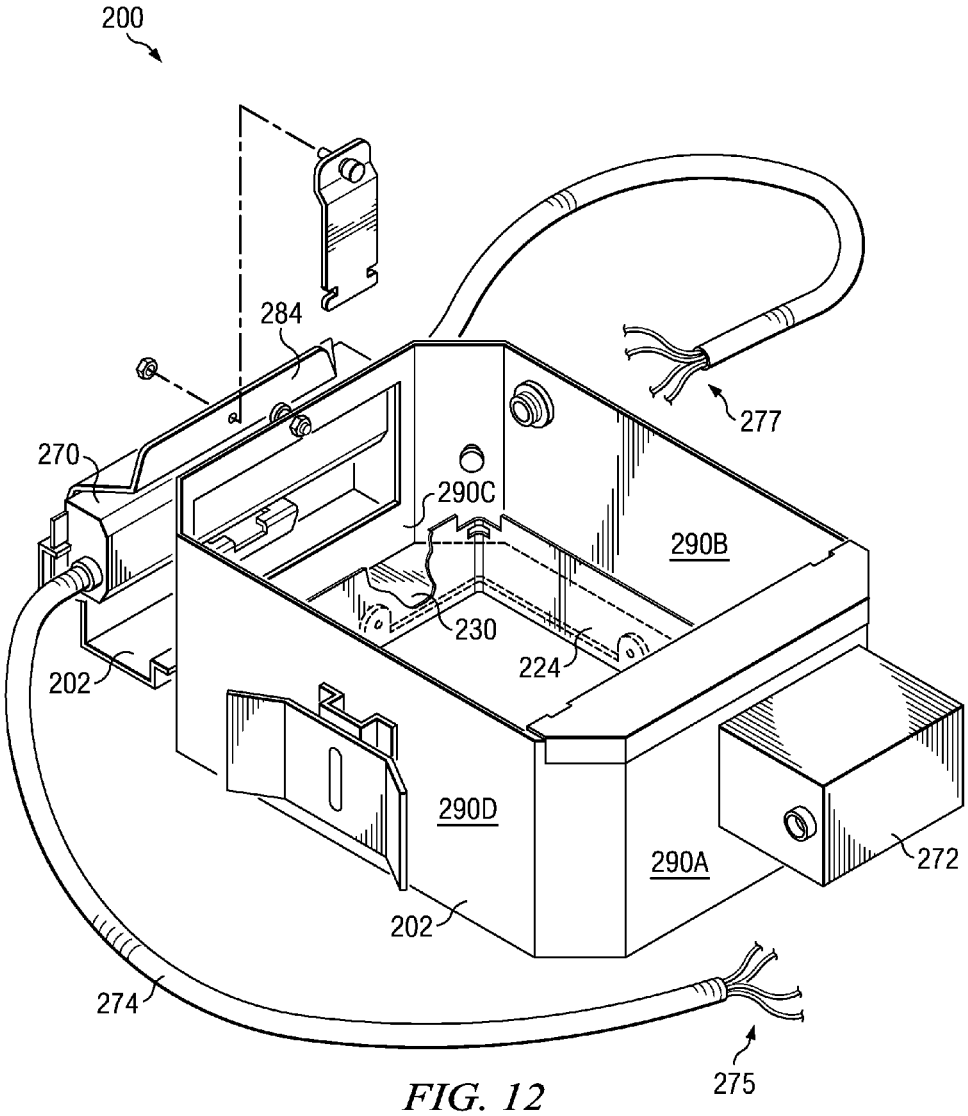
Figure 13:
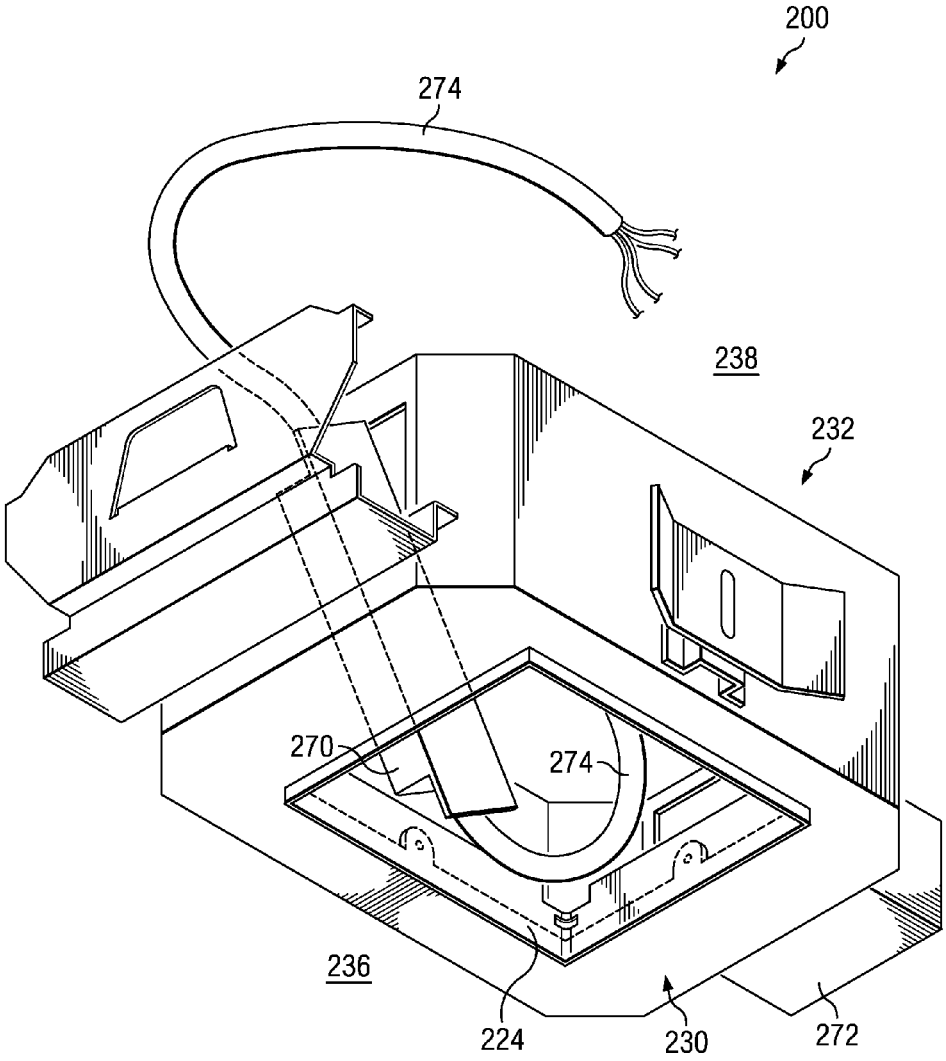

FIGS. 8-13 illustrate various aspects of a lighting system 200 having a housing designed to provide access to an emergency energy source and/or other components, without removing the main housing from the ceiling or wall, according to one example embodiment of the present disclosure. In particular, FIG. 8 illustrates example lighting system 200 with the lamp housing 202 fully assembled, e.g., in the operational state of lighting system 200. FIG. 9 illustrates example lighting system 200 with a lid 258 removed to reveal internal components of lighting system 200. FIG. 10 illustrates example lighting system 200 with a lamp assembly 204 and a first housing portion 252 removed from lamp housing 202 to provide an opening in lamp housing 202 for accessing an externally located junction box 272 and connection for a flexible wiring harness 274 from the interior of a room. FIG. 11 illustrates example lighting system 200 with lamp assembly 204 and a second housing portion 254 removed from lamp housing 202 to provide an opening in lamp housing 202 for accessing an externally located emergency/backup energy source 270 from the interior of the room. FIG. 12 illustrates the disconnection of the emergency/backup energy source 270 and flexible wiring harness 274 via the openings in lamp housing 202. Finally, FIG. 13 illustrates the removal of the emergency/backup energy source 270 and flexible wiring harness 274 through the openings in lamp housing 202.

As shown in FIGS. 8-13, example lighting system 200 may include a lamp housing 202 configured to house a lamp assembly 204, and one or more lighting system components 206 positioned at least partially outside of housing 202.

Lamp assembly 204 may include any components for housing and supplying power to a light source. For example, lamp assembly 204 may include a lamp, a socket for connecting the lamp to an electrical supply, a reflector for reflecting light from the lamp in one or more desired directions, and any suitable connection elements for connecting the components of lamp assembly 204 to each other and/or to lamp housing 202. In the illustrated embodiment, lamp assembly 204 comprises the same or similar assembly as the example lamp assembly 104B shown in FIGS. 6A-6B, discussed above. In other embodiments, lamp assembly 204 comprises the same or similar assembly as the example lamp assembly 104A shown in FIGS. 5A-5B, or the example lamp assembly 104C shown in FIGS. 7A-7B, or any other suitable lamp assembly.

Lamp assembly 204 may be supported by and/or coupled to lamp housing 202 in any suitable manner (e.g., permanently or removably), using any suitable connection elements 220, e.g., screws, clips, hooks, flanges, etc, e.g., as shown in FIG. 10. In some embodiments, lamp assembly 204 may be removably coupled to a mounting collar 224, which may remain coupled to lamp housing 202, such that lamp assembly 204 may be temporarily removed from lamp housing 202 to provide better access to one or more lighting system components 206 via one or more movable or removable portions of lamp housing 202, e.g., as shown in FIG. 10. In some embodiments, an end 277 of flexible wiring conduit 274 may be disconnected from a test switch attached to lamp assembly 204 before removing lamp assembly 204 from housing 202.

Lamp housing 202 may define a first side 230 and an opposing second side 232, as shown in FIGS. 8 and 13. The first side 230 of housing 202 may be configured for attachment to a substrate 234, e.g., a ceiling or wall of the room that lighting system 200 is arranged to light, which separates an interior area 236 of the room from an exterior area 238 outside the room. An example substrate 234 is shown in dashed lines in FIG. 8. In the normal operational state of lighting system 200 shown in FIG. 8, lamp 210 is arranged to emit light through the first side 230 of lamp housing 202 and through an opening in substrate 234 and into the interior area 236 of the room. Lamp housing 202 may connected directly or indirectly to substrate 234 in any suitable manner. For example lamp housing 202 may coupled directly to a ceiling joist or other structural member. In the illustrated example, lamp housing 202 includes connecting flanges 242 configured to engage with a ceiling joist, mounting bracket, or other structural member.

Lamp housing 202 may include a sidewall 250 extending around at least a portion of lamp assembly 204, and a lid 258, as shown in FIG. 9. Lamp housing sidewall 250 may include a first movable or removable portion 252 in a first area 262 of sidewall 250, a second movable or removable portion 254 in a second area 264 of sidewall 250, and a remaining portion 256 of sidewall 250. As shown in FIG. 10, first sidewall portion 252 may be moved or removed from the remaining portion 256 of sidewall 250 to provide a first opening 266 in sidewall 250 for accessing one more lighting system components 206 proximate the first area 262 of sidewall 250 (or connected to component(s) 206 located proximate first area 262). Similarly, as shown in FIG. 11, second sidewall portion 254 may be moved or removed from the remaining portion 256 of sidewall 250 to provide a second opening 268 in sidewall 250 for accessing one more lighting system components 206 proximate the second area 264 of sidewall 250 (or connected to other component(s) 206 located proximate second area 264).

In some embodiments, first and second openings 266 and 268 provided by moving or removing sidewall portions 252 and 254 may provide access to one or more lighting system components 206 from the interior area 236 of the room (e.g., through an opening in substrate 234 and a corresponding opening in first side 230 of lamp housing 202), without having to remove lamp housing 202 from substrate 234 (e.g., the ceiling or wall). Such access may be sufficient for removing, replacing, installing, connecting, disconnecting, repairing, or otherwise accessing one or more components 206. In some embodiments, first and/or second openings 266 and 268 in sidewall 250 provided by moving/removing first and/or second sidewall portions 252 and 254 are sufficiently shaped and sized for passing particular components 206 through openings 266 and/or 268 (e.g., as shown in FIG. 13).

Lighting system components 206 may include any suitable components associated with a lighting system. For example, lighting system components 206 may include any one or more of the following: junction box, energy source, transformer, switch, wiring, wiring conduit or harness, connectors, brackets, other support structures, or any other components associated with a lighting system. As one example, in the illustrated embodiment, lighting system components 206 includes a junction box 272 located outside and proximate first area 262 of sidewall 250, an emergency or backup energy source 270 located outside and proximate second area 264 of sidewall 250, and an elongated flexible wiring conduit 274 connected between emergency/backup energy source 270 and junction box 272, e.g., as shown in FIG. 10. Further, in the illustrated embodiment, a main energy source 280 is securely coupled to the second movable or removable portion 254 of sidewall 250 such that main energy source 280 and second sidewall portion 254 are movable/removable together as a unit, e.g., as shown in FIGS. 10 and 11. Emergency/backup energy source 270 may provide a backup in the event of a failure of the main energy source 280. Main energy source 280 and emergency/backup energy source 270 may comprise any suitable types of energy sources, e.g., ballasts, batteries, etc. In some embodiments, main energy source 280 is a ballast, i.e., a current/electrical control device that converts A/C current provided from an A/C source to a current that can be used by the lamp, and emergency/backup energy source 270 is an emergency/backup battery pack. In particular embodiments, ballast 280 may be required for LED, CFL lamps for emergency/backup energy source 270 to function.

In the illustrated embodiment, first and second openings 266 and 268 provided by moving/removing first and/or second sidewall portions 252 and 254 are sufficiently shaped and sized to allow disconnection and removal, or insertion and connection, of emergency/backup ballast 270 and flexible wiring conduit 274 from the interior 236 of the room. Opening 268 may also be configured for accessing junction box 272 from the interior 236 of the room. Thus, for example, as shown in FIG. 12, a technician may disconnect one end 275 of flexible wiring conduit 274 from junction box 272 through opening 266, and disconnect emergency/backup ballast 270 from a corresponding support bracket 284 through opening 268. The technician may have previously disconnected the other end 277 of flexible wiring conduit 274 from a test switch attached to lamp assembly 204, before removing lamp assembly 204 from housing 202, as discussed above with respect to FIG. 10. After the ends of conduit 274 have been disconnected, the technician may then remove both emergency/backup ballast 270 and flexible wiring conduit 274 through opening 268, e.g., as shown in FIG. 13, all without removing lamp housing 202 from the substrate 234 (e.g., ceiling or wall).

Lamp housing sidewall 250 may have any suitable shape and define any number of sides. For example, in the illustrated example, sidewall 250 defines a rectangular shape having four main sidewall sides 290A-290D that extend generally perpendicular to the first side 230 of lamp housing 202 and/or to substrate 234, e.g., as shown in FIGS. 9 and 12. In other embodiments, sidewall 250 may include any other number of sides. For example, sidewall 250 may define a triangular perimeter, a rounded perimeter, or any other perimeter shape. Further, sidewall 250 may not extending perpendicular to the first side 230 housing 202 and/or to substrate 234. For example, sidewall 250 may define a domed or prism shape.

As shown in FIG. 9, first and second sidewall portions 252 and 254 are positioned in opposing sidewall sides 290A and 290C, and thus spaced apart from each other. In other embodiments, first and second sidewall portions 252 and 254 may be positioned at any other locations relative to lamp housing 202 and/or to each other. For example, first and second sidewall portions 252 and 254 may be positioned in adjacent sidewall sides (e.g., sides 290A and 290B). Further, lamp housing 202 may have only a single movable or removable sidewall portion, or may have more than two movable or removable sidewall portions (e.g., three, four, or more movable or removable sidewall portions).

First and second sidewall portions 252 and 254 may be movably or removably coupled to the remaining sidewall portion 256 of lamp housing 102 using any suitable connectors or in any other suitable manner. For example, as shown in FIG. 10, first sidewall portion 252 is coupled to remaining sidewall portion 256 using (a) a thumbscrew 292A proximate one end of first sidewall portion 252 and (b) one or more flanges 294A an opposite end of first sidewall portion 252 configured to engage with one or more slots 296A formed in remaining sidewall portion 256. Similarly, as shown in FIG. 11, second sidewall portion 254 is coupled to remaining sidewall portion 256 using (a) a thumbscrew 292B proximate one end of second sidewall portion 254 and (b) one or more flanges 294B on second sidewall portion 254 configured to engage with one or more slots 296B (similar to slots 296A) formed in remaining sidewall portion 256 proximate an opposite end of second sidewall portion 254. Thus, each of first and second sidewall portions 252 and 254 may thus be removed by loosening the respective thumbscrew 292A, 292B and sliding the flange(s) 294A or 294B from the respective slot(s) 296A or 296B. In other embodiments, first and/or second sidewall portions 252 and 254 may be coupled to the remaining sidewall portion 256 to allow first and/or second sidewall portions 252 and 254 to be moved relative to remaining sidewall portion 256—in order to expose openings 266 and/or 268—but remain coupled to the remaining sidewall portion 256. For example, first and/or second sidewall portions 252 and 254 may pivot or rotate relative to remaining sidewall portion 256 to expose openings 266 and/or 268.

Further, as shown in FIG. 9, lid 258 is coupled to lamp housing sidewall 250 using (a) a thumbscrew 292C proximate one end of lid 258 and (b) one or more flanges 294C on lid 258 configured to engage with one or more slots 296C formed in sidewall 250 proximate an opposite end of lid 258. In other embodiments, lid 258 may be coupled to sidewall 250 such that lid 258 can be moved to provide access to the interior of lamp housing 202 from above, but remain coupled to sidewall 250. For example, lid 258 may pivot or rotate relative to sidewall 250 to provide top access to the interior of lamp housing 202.

In some embodiments, such as the illustrated embodiment, first and second sidewall portions 252 and 254 may be moved or removed from the interior area 236 of the room (e.g., through an opening in substrate 234 and a corresponding opening in first side 230 of lamp housing 202), without having to remove lamp housing 202 from substrate 234 (e.g., the ceiling or wall). Further, first and second sidewall portions 252 and 254 may be moved or removed from the exterior area 238 outside the room by removing lid 258 from above, without having to remove lamp housing 202 from substrate 234. In other embodiments, one, some, or all of first sidewall portion 252, second sidewall portion 254, and lid 258 may be moved or removed from both the interior 236 and exterior 238 of the room. It should be understood that first sidewall portion 252, second sidewall portion 254, and lid 258 may be movably or removably coupled to lamp housing 202 using any other suitable connectors or in any other suitable manner.

Although the disclosed embodiments are described in detail in the present disclosure, it should be understood that various changes, substitutions and alterations can be made to the embodiments without departing from their spirit and scope.

What is claimed is:

1. An adjustable device for supporting a lamp, comprising:

a bracket configured to be directly or indirectly mounted to a substrate;

a lamp housing configured for supporting a lamp; and an adjustment system adjustably coupling the lamp housing to the bracket, the adjustment system defining a plurality of different selectable positions of the lamp housing relative to the bracket;

wherein the adjustment system enables translation and rotation of the lamp housing relative to the bracket to move the lamp housing between the plurality of selectable positions relative to the bracket;

wherein the adjustment system includes a locking system to secure the lamp housing in each of the selectable positions relative to the bracket;

wherein the locking system includes a spring-biased locking element configured to engage with each of a plurality of different locking position structures corresponding to the plurality of different selectable positions of the lamp housing relative to the bracket.

2. The adjustable device according to claim 1, wherein the adjustment system includes:

a first pair of elongated curved guide structures provided by one of the bracket and the lamp housing; and a second pair of elongated curved guide structures provided by one of the bracket and the lamp housing;

at least two guide elements provided by the other of the bracket and the lamp housing, each guide element slidably engaged in one of the elongated curved guide structures;

wherein movement of the at least two guide elements along the at least two elongated curved guide structures causes the lamp housing to simultaneously translate and rotate relative to the housing to position the lamp housing in any of the plurality of different selectable positions relative to the bracket.

3. The adjustable device according to claim 1, wherein the adjustment system defines at least three different selectable positions of the lamp housing relative to the bracket.

4. The adjustable device according to claim 1, wherein the adjustment system defines infinite selectable positions of the lamp housing relative to the bracket.

5. The adjustable device according to claim 1, wherein the adjustment system defines at least:

a first selectable position of the lamp housing configured such that a longitudinal axis of a lamp supported in the lamp housing extends in a perpendicular direction relative to the substrate to which the bracket is coupled;

a second selectable position of the lamp housing configured such that the longitudinal axis of the lamp is offset from the perpendicular direction in a first direction; and a third selectable position of the lamp housing configured such that the longitudinal axis of the lamp is offset from the perpendicular direction in a second direction opposite the first direction.

6. The adjustable device according to claim 1, wherein the adjustment system includes:

at least two elongated curved guide structures provided by one of the bracket and the lamp housing; and at least two guide elements provided by the other of the bracket and the lamp housing, each guide element slidably engaged with one of the elongated curved guide structures;

wherein movement of the at least two guide elements along the at least two elongated curved guide structures causes the lamp housing to simultaneously translate and rotate relative to the housing to position the lamp housing in any of the plurality of different selectable positions relative to the bracket.

7. The adjustable device according to claim 6, wherein:

the elongated curved guide structures comprise elongated curved slots; and the guide elements comprises protrusions slidably received in the elongated curved slots.

8. The adjustable device according to claim 6, wherein:

the guide elements comprises slots;

the elongated curved guide structures comprise elongated curved protrusions slidably received in the slots.

9. The adjustable device according to claim 6, wherein:

the elongated curved guide structures are formed in or coupled to the bracket; and the guide elements are integral with or coupled to the lamp housing.

10. The adjustable device according to claim 6, wherein:

the elongated curved guide structures are formed in or coupled to the lamp housing; and the guide elements are integral with or coupled to the bracket.

11. The adjustable device according to claim 6, wherein the at least two elongated curved guide structures include a first elongated curved guide structure defining a first radius of curvature and a second elongated curved guide structure defining a second, different radius of curvature.

12. The adjustable device according to claim 6, wherein:

a first guide element is slidably engaged in a first elongated curved guide structure defining a first length of travel for the first guide element;

a second guide element is slidably engaged in a second elongated curved guide structure defining a second length of travel for the second guide element; and wherein the second length of travel defined by the second guide element is greater than the first length of travel defined by the first guide element, such that during adjustment of the lamp housing relative to the bracket, the second guide element travels further than the first guide element.

13. The adjustable device according to claim 6, wherein the at least two elongated curved guide structures extend in the same plane.

* * * * *